US005614815A

United States Patent [19]

Yamagata et al.

[11] Patent Number: 5,614,815

[45] Date of Patent: Mar. 25, 1997

[54] CONSTANT VOLTAGE SUPPLYING CIRCUIT

[75] Inventors: Seiji Yamagata; Shinya Udo; Fumitaka Asami, all of Kawasaki, Japan

[73] Assignee: Fujitsu Limited, Kawasaki, Japan

[21] Appl. No.: 401,272

[22] Filed: Mar. 9, 1995

[30] Foreign Application Priority Data

Mar. 10, 1994 [JP] Japan ..... 6-039419
Mar. 7, 1995 [JP] Japan ..... 7-047308

[51] Int. Cl.[6] ..... G05F 3/16

[52] U.S. Cl. ..... 323/313; 327/538

[58] Field of Search ..... 323/311, 313, 323/314, 312; 327/530, 538

[56] References Cited

U.S. PATENT DOCUMENTS

| | | | |
|---|---|---|---|
| 4,499,416 | 2/1985 | Koike | 323/303 |
| 4,692,689 | 9/1987 | Takemae | 323/313 |
| 4,814,686 | 3/1989 | Watanabe | 323/229 |
| 5,258,703 | 11/1993 | Pham et al. | 323/313 |
| 5,315,230 | 5/1994 | Cordoba et al. | 323/313 |
| 5,532,578 | 7/1996 | Lee | 323/313 |
| 5,545,977 | 8/1996 | Yamada et al. | 323/313 |

*Primary Examiner*—Peter S. Wong
*Assistant Examiner*—Adolf Berhane
*Attorney, Agent, or Firm*—Armstrong, Westerman, Hattori, McLeland & Naughton

[57] ABSTRACT

A constant voltage supplying circuit is disposed between a voltage output terminal of a voltage generation circuit for outputting a voltage having the same polarity as that of a reference voltage, which can be arbitrarily set, and having a greater absolute value than the reference voltage, and a load. This constant voltage supplying circuit includes a first field effect transistor a gate of which is connected to its drain, and to a source of which the reference voltage is supplied, and a second field effect transistor which has the same conductivity type as the first field effect transistor, a gate of which is connected to the drain of the first field effect transistor, a source of which is connected to the voltage output terminal of the voltage generation circuit, and a drain of which is connected to the ground. According to the circuit constitution, the output voltage of the voltage generation circuit can be stabilized to a desired voltage value (the same voltage value as the reference voltage). Even when the constant voltage supplying circuit is fabricated in an integrated circuit, it does not invite the increase of the production process, and thus can limit the increase of the cost of production.

28 Claims, 29 Drawing Sheets

CONSTANT VOLTAGE SUPPLYING CIRCUIT

BACKGROUND OF THE INVENTION

1. Field of the Invention

This invention relates to a constant voltage supplying circuit which is interposed between a voltage generation circuit and a load, stabilizes an output voltage of the voltage generation circuit to a desired voltage value and supplies the voltage to the load.

2. Description of the Related Art

FIG. 1 shows the constitution of a constant voltage supplying circuit as an example of the prior art.

In the drawing, reference numeral 1 denotes a voltage generation circuit which generates a positive voltage VDD1 at the time of non-load; 1A denotes a voltage output terminal of the voltage generation circuit 1; 2 denotes an internal resistance of the voltage generation circuit; and VD1 denotes a voltage of the voltage output terminal 1A when the load is connected. Reference numeral 3 denotes a constant voltage supplying circuit and reference numeral 4 denotes a Zener diode which constitutes the constant voltage supplying circuit 3. The Zener voltage (hereinafter called "VZ") of this Zener diode is set to be lower than the voltage VDD1 output by the voltage generation circuit at the time of non-load. Symbol VOUT denotes the output voltage of the constant voltage supplying circuit, GND denotes an earth voltage and reference numeral 5 denotes a resistor as the load.

In the constitution described above, the constant voltage supplying circuit 3 stabilizes the voltage VD1 output to the voltage output terminal 1A of the voltage generation circuit 1 so that it becomes equal to the Zener voltage VZ of the Zener diode 4 (VD1>VZ>0), and supplies it as the output voltage VOUT to the load resistor 5.

However, the constant voltage supplying circuit 3 according to the prior art described above involves the problem that the output voltage VOUT to be supplied to the load fluctuates due to variance of characteristics of the Zener diode 4.

Originally, the Zener diode 4 itself is a device for obtaining a constant voltage by causing a current to flow therethrough. Therefore, another problem exists in that power consumption other than that of the load is great.

Further, when the Zener diode 4 is used as a component to be externally mounted, the number of components increases. When the Zener diode is fabricated inside an integrated circuit to avoid this problem, the number of production steps increases and eventually, the cost of production increases.

SUMMARY OF THE INVENTION

An object of the present invention is to provide a constant voltage supplying circuit which can stabilize an output voltage of a voltage generation circuit to a desired voltage value irrespective of variance of characteristics of constituent elements, does not invite the increase of the number of production steps even when it is fabricated inside an integrated circuit and can eventually restrict the increase of the production cost.

According to a first aspect of the present invention, there is provided a constant voltage supplying circuit disposed between a load and a voltage output terminal of a voltage generation circuit for outputting a voltage having the same polarity as that of a reference voltage capable of being set arbitrarily, and having an absolute value greater than the reference voltage, which comprises a first field effect transistor having a gate thereof connected to a drain thereof, and supplied with the reference voltage at a source thereof; and a second field effect transistor having the same conductivity type as that of the first field effect transistor, and having a gate thereof connected to the drain of the first field effect transistor, a source thereof connected to the voltage output terminal of the voltage generation circuit and a drain thereof grounded; wherein a voltage at the voltage output terminal of the voltage generation circuit is stabilized to the same voltage value as the reference voltage.

According to a second aspect of the present invention, there is provided a constant voltage supplying circuit disposed between a load and a voltage output terminal of a voltage generation circuit for outputting a voltage having the same polarity as that of a reference voltage capable of being set arbitrarily, and having an absolute value greater than the reference voltage, which comprises a first field effect transistor having a gate thereof connected to a drain thereof, and supplied with the reference voltage at a source thereof; a second field effect transistor having the same conductivity type as that of the first field effect transistor, and having a gate thereof connected to the drain of the first field effect transistor, and a source thereof connected to the voltage output terminal of the voltage generation circuit; a voltage difference generation circuit for generating a predetermined voltage difference between a drain of the second field effect transistor and the ground; and a third field effect transistor having a conductivity type different from that of the first field effect transistor, and having a gate thereof connected to the drain of the second field effect transistor, a drain thereof connected to the voltage output terminal of the voltage generation circuit and a source thereof connected to the ground; wherein a voltage at the voltage output terminal of the voltage generation circuit is stabilized to the same voltage as the reference voltage.

According to a third aspect of the present invention, there is provided a constant voltage supplying circuit disposed between a load and a voltage output terminal of a voltage generation circuit for outputting a voltage having the same polarity as that of a reference voltage capable of being set arbitrarily, and having an absolute value greater than the reference voltage, which comprises a first voltage difference generation circuit for receiving the reference voltage and shifting the voltage level by a predetermined level; a first field effect transistor having a gate thereof connected to an output terminal of the first voltage difference generation circuit and a source thereof connected to an output terminal of the constant voltage supplying circuit; a second voltage difference generation circuit for generating a predetermined voltage difference between a drain of the first field effect transistor and the ground; a second field effect transistor having a conductivity type different from that of the first field effect transistor, and having a gate thereof connected to the drain of the first field effect transistor and a source thereof connected to the ground; a third voltage difference generation circuit for generating a predetermined voltage difference between a drain of the second field effect transistor and the voltage output terminal of the voltage generation circuit; and a third field effect transistor having a conductivity type different from that of the first field effect transistor, connected between the voltage output terminal of the voltage generation circuit and the output terminal of the constant voltage supplying circuit, and responsive to a drain potential of the second field effect transistor; wherein an output voltage obtained at the output terminal of the constant voltage supplying circuit is stabilized to the same voltage value as the reference voltage.

According to a fourth aspect of the present invention, there is provided a constant voltage supplying circuit disposed between a load and a voltage output terminal of a voltage generation circuit for outputting a voltage having the same polarity as that of a reference voltage capable of being set arbitrarily, and having an absolute value greater than the reference voltage, which comprises a first voltage difference generation circuit for receiving the reference voltage and shifting the voltage level by a predetermined level; a first field effect transistor having a gate thereof connected to an output terminal of the first voltage difference generation circuit and a source thereof connected to an output terminal of the constant voltage supplying circuit; a second voltage difference generation circuit for generating a predetermined voltage difference between a drain of the first field effect transistor and the ground; a CMOS inverter driver circuit provided with a CMOS inverter connected between the voltage output terminal of the voltage generation circuit and the ground, and responsive to a drain potential of the first field effect transistor; and a second field effect transistor connected between the voltage output terminal of the voltage generation circuit and the output terminal of the constant voltage supplying circuit, and responsive to an output of the CMOS inverter driver circuit; wherein an output voltage obtained at the output terminal of the constant voltage supplying circuit is stabilized to the same voltage value as the reference voltage.

BRIEF DESCRIPTION OF THE DRAWINGS

These and other objects and novel features of the present invention will be described hereinafter in detail by way of preferred embodiments with reference to the accompanying drawings, in which.

DESCRIPTION OF THE PREFERRED EMBODIMENTS

Figure 1:
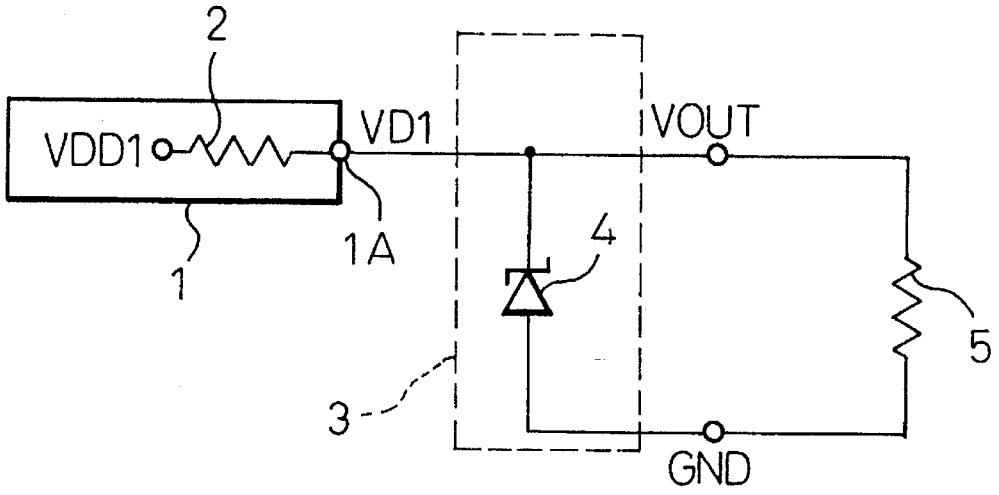
Fig.1 PRIOR ART
FIG. 1 is a circuit diagram showing the constitution of a constant voltage supplying circuit as an example of the prior art.
Figure 2:
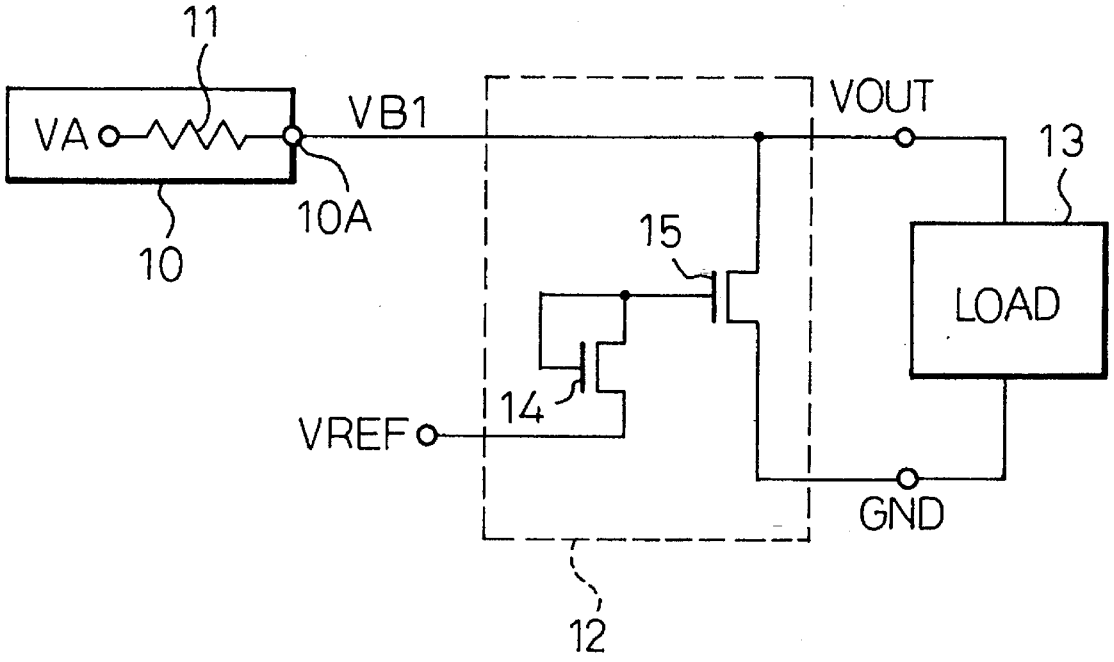
FIG. 2 is a structural view showing the principle of the constant voltage supplying circuit according to the first aspect of the present invention.

FIG. 2 is a circuit diagram showing the principle of the constant voltage supplying circuit according to the first aspect of the present invention.

In the drawing, reference numeral 10 denotes a voltage generation circuit which generates a voltage VA at the time of non-load; 10A is a voltage output terminal of the voltage generation circuit; 11 is an internal resistance of the voltage generation circuit 10; VB1 is a voltage of the voltage output terminal 10A when a load is connected; 12 is a constant voltage supplying circuit according to the first embodiment of the present invention; and 13 is a load.

In the constant voltage supplying circuit 12, reference numerals 14 and 15 denote field effect transistors having the same conductivity type. The gate of the field effect transistor is connected to the drain, and a reference voltage VREF having the same polarity as the voltage VA, which is output by the voltage generation circuit 10 at the time of non-load, and having an absolute value smaller than the voltage VA, is supplied to the source of this field effect transistor 14. The gate of the field effect transistor 15 is connected to the drain of the field effect transistor 14, its drain is connected to the voltage output terminal 10A of the voltage generation circuit 10, and its source is grounded.

The constant voltage supplying circuit 12 so functions as to stabilize the voltage VB1 of the voltage output terminal 10A of the voltage generation circuit 10 to a voltage value equal to the reference voltage VREF.

In the constitution described above, the field effect transistors 14 and 15 can be produced using an identical process. Accordingly, even if there is any deviation in the production process, the relationship between respective threshold values of the transistors 14 and 15 is not changed. Now, assuming that each threshold value of the transistors 14 and 15 is VTH, the gate voltage $G_{15}$ of the field effect transistor 15 is given by $G^{15}$=VREF+VTH. As a result, the gate-source voltage $VGS_{15}$ of the field effect transistor 15 is given by $VGS_{15}=VG_{15}-VB1=(VREF+VTH)-VB1=(VREF-VB1)+VTH$ where VB1 is the voltage of the voltage output terminal 10A of the voltage generation circuit 10.

Assuming that the field effect transistors 14 and 15 are p-MOS transistors, $VGS_{15}$ (negative voltage)<VTH (negative voltage) as long as VB1 (positive voltage)>VREF (positive voltage). Therefore, the field effect transistor 15 keeps the ON (conductive) state, and the current flows not only through the load 13 but also through the field effect transistor 15, so that the voltage VB1 at the voltage output terminal 10A of the voltage generation circuit 10 changes.

In contrast, if the field effect transistors 14 and 15 are n-MOS transistors, $VGS_{15}$ (positive voltage)>VTH (positive voltage) as long as VB1 (negative voltage)<VREF (negative voltage). Therefore, the field effect transistor 15 keeps the ON state, and the current flows not only through the load 13 but also through the field effect transistor 15, so that the voltage VB1 at the voltage output terminal 10A of the voltage generation circuit 10 changes.

In either case, $VGS_{15}$=VTH at the point of time when the relation VB1=VREF is satisfied. Therefore, the field effect transistor 15 is turned OFF (non-conductive). Thereafter, the current flows only through the load 13 and the voltage VB1 at the voltage output terminal 10A of the voltage generation circuit 10 keeps the same voltage value as the reference voltage VREF.

As described above, the constant voltage supplying circuit 12 stabilizes the voltage VB1 at the voltage output terminal 10A of the voltage generation circuit 10 to the same voltage value as the reference voltage VREF, and supplies it as the output voltage VOUT to the load 13.

Consequently, the constant voltage supplying circuit 12 shown in FIG. 2 can stabilize the voltage VB1 at the voltage output terminal 10A of the voltage generation circuit 10 to the same voltage value as the reference voltage VREF irrespective of variance of the characteristics of the field effect transistors 14, 15.

Figure 3:
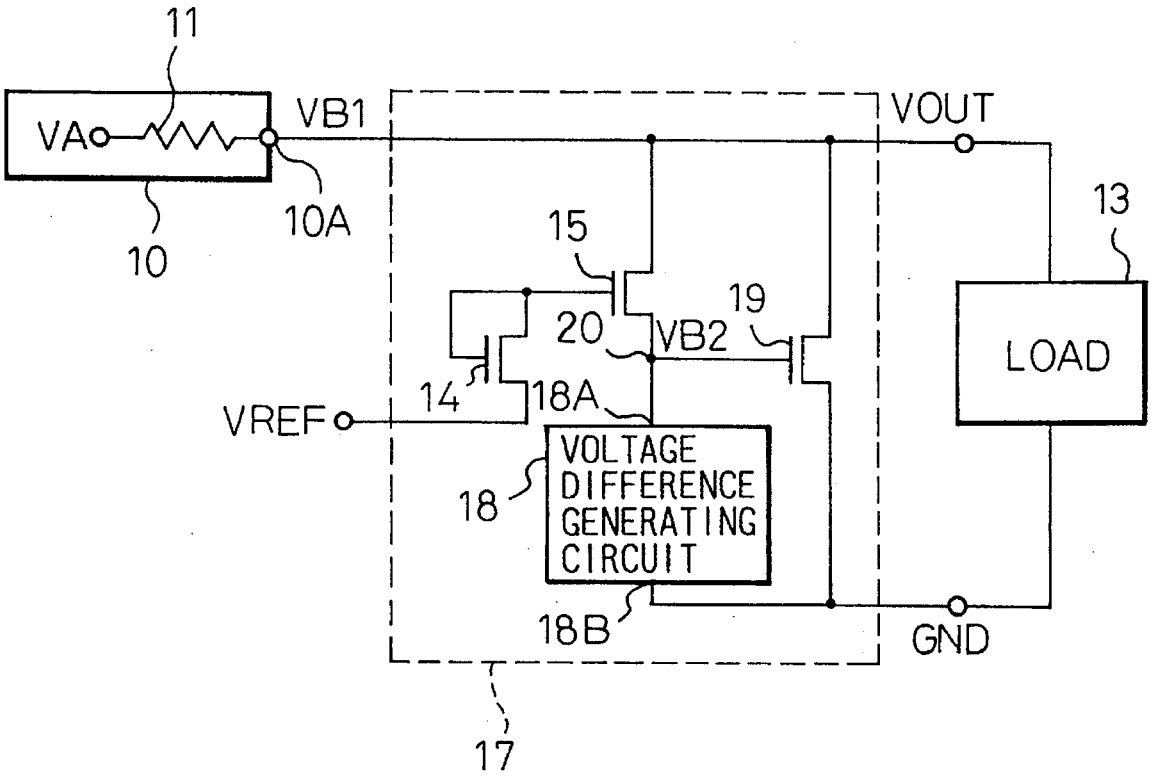
FIG. 3 is a structural view showing the principle of the constant voltage supplying circuit according to the second aspect of the present invention.

FIG. 3 is a circuit diagram showing the principle of the constant voltage supplying circuit according to the second aspect of the present invention.

This constant voltage supplying circuit 17 includes a voltage difference generation circuit 18 and a field effect transistor 19. Since the rest of the circuit constitution are the same as those of the constant voltage supplying circuit 12 shown in FIG. 2, its explanation will be omitted.

One (18A) of the end portions of the voltage difference generation circuit 18 is connected to the drain of the field effect transistor 15 and the other end portion (18B) is grounded. When the current flows between these end portions 18A and 18B, a voltage difference is generated between them. The field effect transistor 19 has a different conductivity type from that of the field effect transistors 14 and 15. The gate of the field effect transistor 19 is connected to the drain of the field effect transistor 15, its drain is connected to the voltage output terminal 10A of the voltage generation circuit 10 and its source is grounded.

When the field effect transistors 14 and 15 are the p-MOS transistors in the constant voltage supplying circuit 17, the current flows through the field effect transistor 15 as long as VB1 (positive voltage)>VREF (positive voltage) in the same way as in the constant voltage supplying circuit 12 shown in FIG. 2.

In contrast, when the field effect transistors 14 and 15 are the n-MOS transistors, the current flows through the field effect transistor 15 as long as VB1 (negative voltage)<VREF (negative voltage) in the same way as in the constant voltage supplying circuit 12 shown in FIG. 2.

Therefore, a predetermined difference occurs in the voltage difference generation circuit 18 in either case, and a certain voltage VB2 appears at a node 20.

The field effect transistor 19 can be turned OFF by this voltage VB2, and the current can be caused to flow not only through the load resistor 13 but also through the field effect transistors 15 and 19, so that the voltage VB1 at the voltage output terminal 10A of the voltage generation circuit can be reduced as much to VREF.

As described above, the constant voltage supplying circuit 17 according to the second embodiment of the present invention can stabilize the voltage VB1 at the voltage output terminal 10A of the voltage generation circuit 10 to the same voltage value as the reference voltage VREF and can shorten the stabilization time than in the constant voltage supplying circuit 12 shown in FIG. 2.

Figure 4:
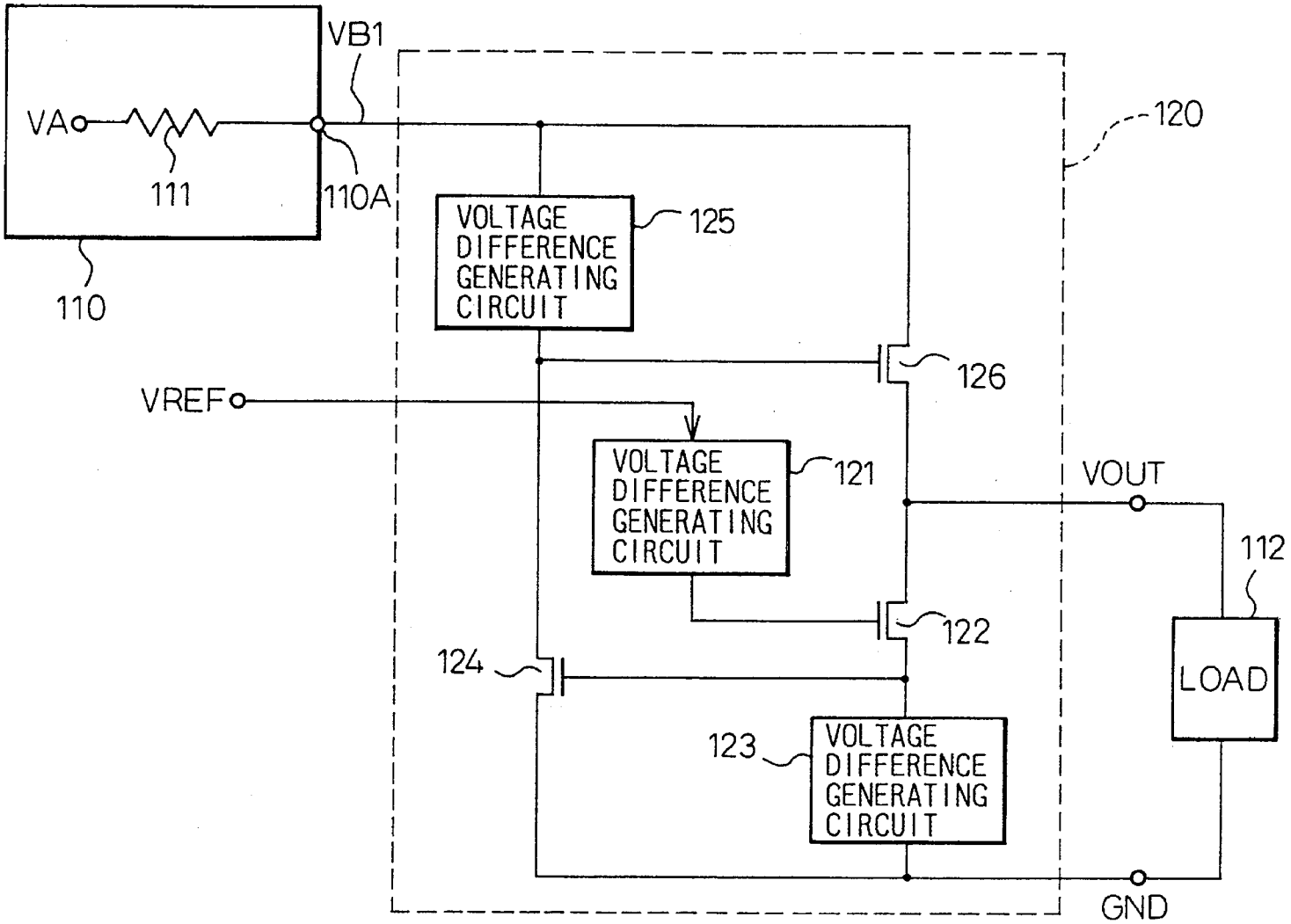
FIG. 4 is a structure view showing the principle of the constant voltage supplying circuit according to the third aspect of the present invention.

FIG. 4 is a circuit diagram showing the principle of the constant voltage supplying circuit according to the third aspect of the present invention.

In the drawing, reference numeral 120 denotes the constant voltage supplying circuit according to the third embodiment of the present invention. This circuit 120 is interposed between the voltage output terminal 110A of the voltage generation circuit 110 and the load 112. The voltage generation circuit 110 in this case outputs the voltage VB1 having the same polarity as that of the reference voltage VREF, which can be set arbitrarily, and an absolute value greater than the reference voltage VREF, to its voltage output terminal 110A.

The constant voltage supplying circuit 120 shown in the drawing comprises a first voltage difference generation circuit 121 for receiving the reference voltage VREF and shifting the level of the reference voltage VREF by a predetermined level, a first field effect transistor 122 the gate of which is connected to the output terminal of the first voltage difference generation circuit 121 and the source of which is connected to the output terminal of the constant voltage supplying circuit 120, a second voltage difference generation circuit 123 for generating a predetermined voltage difference between the drain of the first field effect transistor 122 and the ground GND, a second field effect transistor 124 which has a different conductivity type from that of the first field effect transistor 122, the gate of which is connected to the drain of the first field effect transistor 122 and the source of which is connected to the ground GND, a third voltage difference generation circuit 125 for generating a predetermined voltage difference between the drain of the second field effect transistor 124 and the voltage output terminal 110A of the voltage generation circuit 110, and a third field effect transistor 126 which has a different conductivity type from that of the first field effect transistor 122, is connected between the voltage output terminal 110A of the voltage generation circuit 110 and the output terminal of the constant voltage supplying circuit 120, and responds to the drain potential of the second field effect transistor 124.

The constant voltage supplying circuit 120 so functions as to stabilize the output voltage VOUT obtained at the output terminal thereof to the same voltage value as that of the reference voltage VREF.

Assuming that the first field effect transistor 122 is a p-MOS transistor, the second and third field effect transistors 124 and 126 are n-MOS transistors, respectively.

A voltage obtained by shifting the level of the reference voltage VREF by a predetermined level (level down, in this case) by the first voltage difference generation circuit 121 is applied to the gate of the first field effect transistor 122. In the preferred embodiment of the present invention, this predetermined level is so selected as to be equal to the threshold value of the MOS transistors (the threshold voltage of the p-MOS transistor, in this case).

Assuming that the threshold voltage of the p-MOS transistor is VTHp (<0), for example, the gate potential of the first field effect transistor 122 (p-MOS transistor) is VREF−|VTHp|, and the gate-source voltage of this transistor 122 ($VGS_{22}$) is given by $VGS_{22}$=(VREF−|VTHp|)−VOUT=(VREF−VOUT)−|VTHp|). VREF, the first field effect transistor 122 is turned ON. While VOUT<VREF, on the contrary, $VGS_{22}$>−|VTHp|, so that the first field effect transistor 122 is turned OFF.

Here, a voltage VB1 containing a ripple is biased to the gate and drain of the third field effect transistor 126 (n-MOS transistors) by the voltage generation circuit 110. Since VOUT=0 at the beginning, the gate-source voltage $VGS_{26}$ of the transistor 126 and its threshold voltage $VTH_n$ (>0) have the relation $VGS_{26}$>$VTH_n$, so that the transistor 126 is turned ON. Accordingly, a current path of VB1→transistor 126→VOUT→load 122→GND is formed, and the output voltage VOUT rises from 0.

(1) When output voltage VOUT>VREF:

In this case, the first field effect transistor 122 (p-MOS transistor) is turned ON, and a current path of VB1→transistor 126→VOUT→transistor 122→voltage difference generation circuit 123→GND is formed in addition to the current path passing the load 112 described above. Accordingly, the drain potential of the transistor 122 exhibits a certain potential.

Here, assuming that the gate-source voltage of the second field effect transistor 124 (n-MOS transistor) is $VGS_{24}$, the transistor 124 is turned ON when $VGS_{24}$>$VTH_n$ because $VGS_{24}$=(the drain potential of the transistor 122). Accordingly, a current path of VB1→voltage difference generation circuit 125→transistor 124→GND is formed. As a result, the drain potential of the transistor 124 is lowered by a predetermined level from the output voltage VB1 by the third voltage difference generation circuit 125. When the current further increases, the gate-source voltage $VGS_{26}$ of the transistor 126 becomes greater than (drain potential of the transistor 124)−VOUT<$VTH_n$, so that this transistor 126 is turned OFF.

Accordingly, the supply of the current from the voltage generation circuit 110 (output voltage VB1) to the load 112 is stopped, and the output voltage VOUT starts lowering, and reaches equilibrium when VOUT=VREF.

(2) When output voltage VOUT<VREF:

In this case, the first field effect transistor 122 (p-MOS transistor) is turned OFF, and the (drain potential of the transistor 122)=$VGS_{24}$=0, so that the transistor 124 is turned OFF. As a result, the gate voltage of the transistor 126 is raised to the same level as the output voltage VB1 of the voltage generation circuit 110, and the transistor 126 is turned ON.

In consequence, the current is supplied from the voltage generation circuit 110 (output voltage VB1) to the load 112 through the transistor 126, and the output voltage VOUT starts rising, and finally reaches equilibrium at the point when VOUT=VREF.

As described above, the constant voltage supplying circuit 120 according to the third embodiment of the present invention so functions as to assume (1) the state where the transistors 122 and 124 are ON and the transistor 126 is OFF, or (2) the state where the transistors 122 and 124 are OFF and the transistor 126 is ON. In other words, since this circuit employs the closed loop structure, it can stabilize the output voltage VOUT to the same voltage value as that of a desired reference voltage VREF, by suitably repeating the operations (1) and (2) described above.

Figure 5:
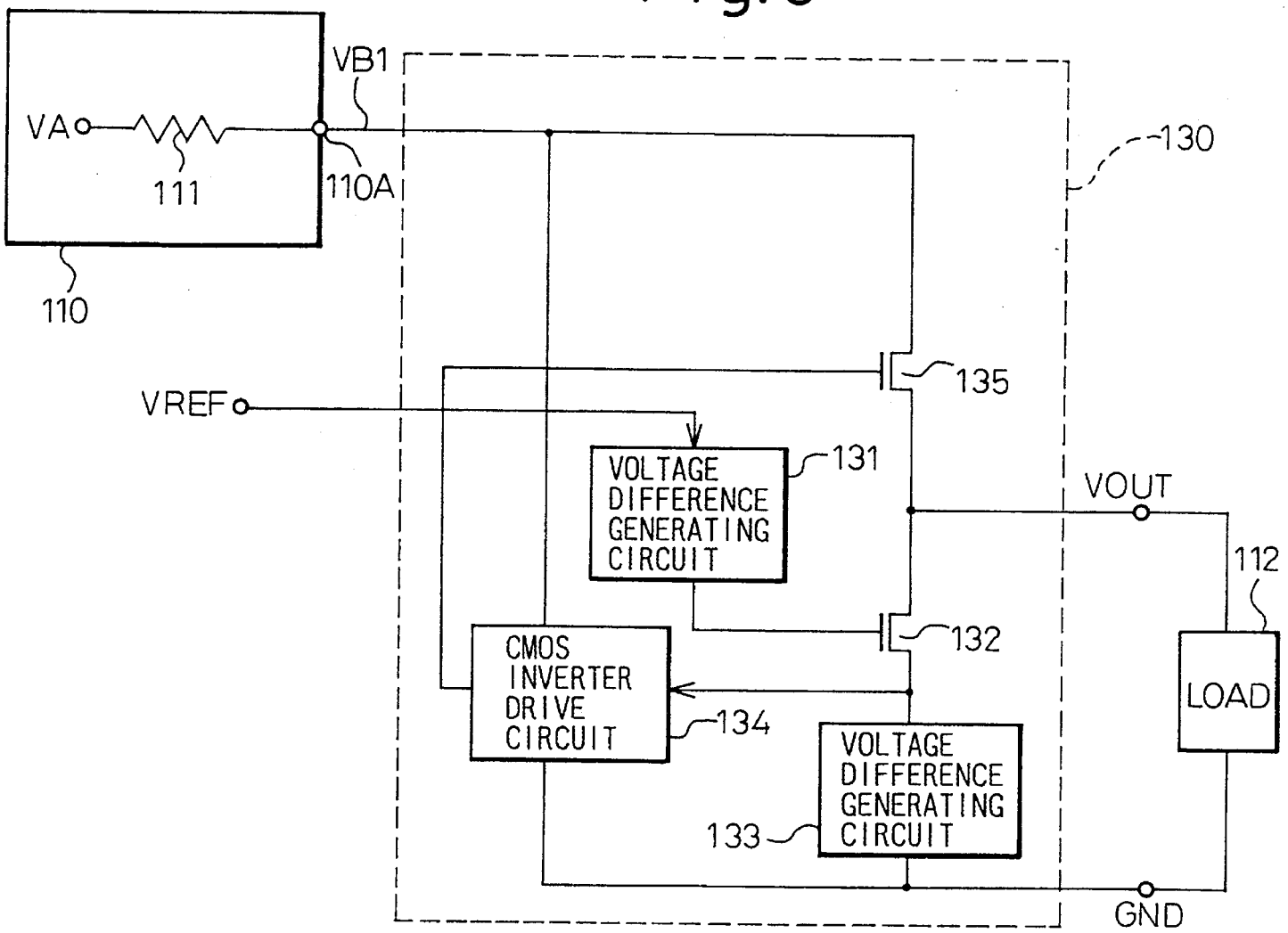
FIG. 5 is a structural view showing the principle of the constant voltage supplying circuit according to the fourth aspect of the present invention.

FIG. 5 is a circuit diagram showing the principle of the constant voltage supplying circuit according to the fourth aspect of the present invention.

In the drawing, reference numeral 130 denotes the constant voltage supplying circuit according to the fourth embodiment of the present invention. This circuit 130 is interposed between the voltage output terminal 110A of the voltage generation circuit 110 for outputting a voltage VB1 having the same polarity as the reference voltage VREF, which can be set arbitrarily, and having a greater absolute value than the reference voltage VREF, and the load 112, in the same way as in the third embodiment.

The constant voltage supplying circuit 130 shown in the drawing comprises a first voltage difference generation circuit 131 for receiving the reference voltage VREF and shifting its voltage level by a predetermined level, a first field effect transistor 132 the gate of which is connected to the output terminal of the first voltage difference generation circuit 131 and the source of which is connected to the output terminal of the constant voltage supplying circuit 130, a second voltage difference generation circuit 133 for generating a predetermined voltage difference between the drain of this first field effect transistor 132 and the ground GND, a CMOS inverter driver circuit 134 which is connected between the voltage output terminal 110A of the voltage generation circuit 110 and the ground GND and is equipped with a CMOS inverter responsive to the drain potential of the first field effect transistor 132, and a second field effect transistor 135 connected between the voltage output terminal 110A of the voltage generation circuit 110 and the output terminal of the constant voltage supplying circuit 130, and responsive to the output of the CMOS inverter driver circuit 134.

This constant voltage supplying circuit 130 so functions as to stabilize the output voltage VOUT obtained at the output terminal thereof to the same voltage value as the reference voltage VREF.

Since the mode of the operation of the constant voltage supplying circuit 130 according to the fourth embodiment of the present invention is fundamentally the same as that of the constant voltage supplying circuit 120 according to the third embodiment, its explanation will be omitted.

In the constitution of the constant voltage supplying circuit 120 according to the third embodiment described above, ON/OFF control of the field effect transistor 126 connected to the output terminal is effected by using the field effect transistor 124 and the voltage difference generation circuit 125 but in the constant voltage supplying circuit according to this fourth embodiment, ON/OFF control of the field effect transistor 135 connected to the output terminal is made by using the CMOS inverter driver circuit 134.

Accordingly, in comparison with the constant voltage supplying circuit shown in FIG. 4, ON/OFF control of the field effect transistor 135 connected to the output terminal can be made more quickly, so that the output voltage VOUT can be stabilized more quickly to the desired reference voltage VREF.

Next, the constant voltage supplying circuit of each of the first to fourth embodiments of the present invention will be explained in further detail with reference to FIGS. 6 to 33.

Figure 6:
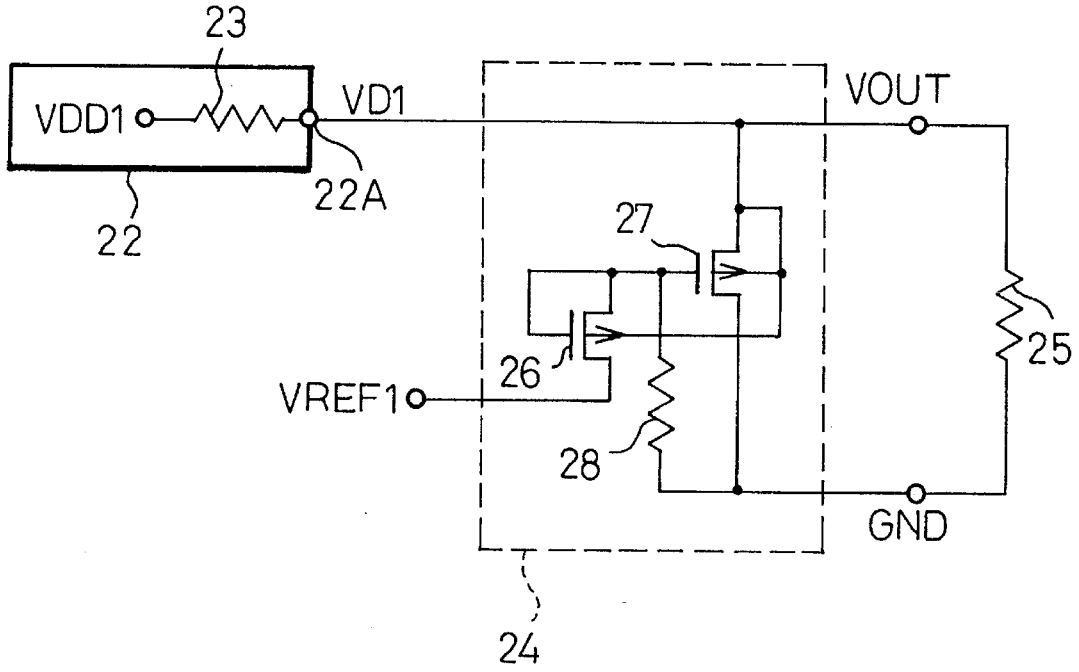
FIG. 6 is a circuit diagram showing the constitution of the constant voltage supplying circuit according to a first embodiment of the present invention.
Figure 7:
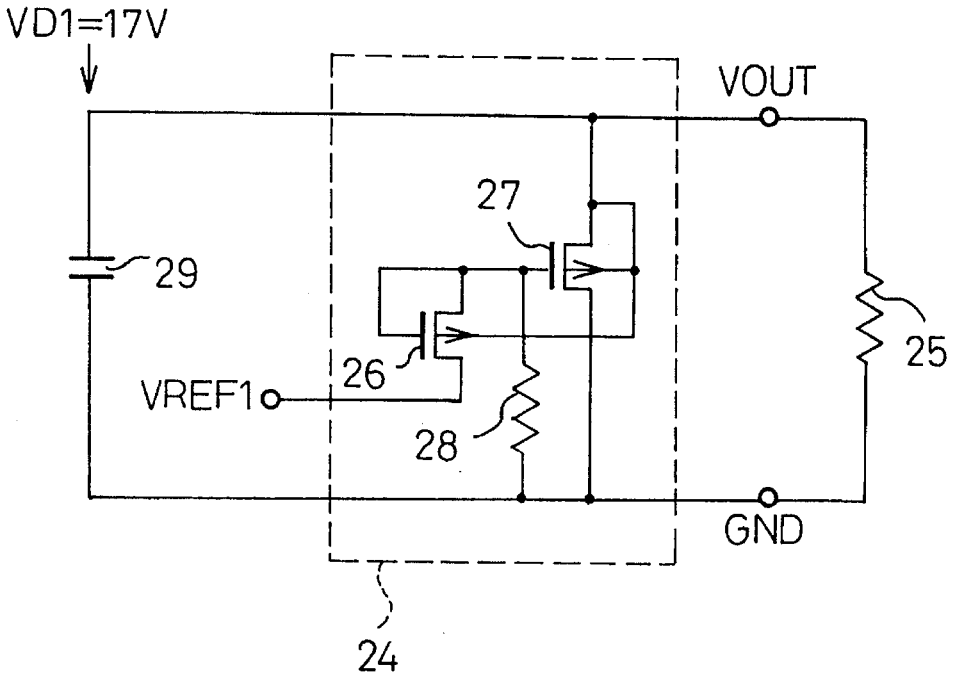
FIG. 7 is a circuit diagram of a circuit for examining the voltage characteristics of the circuit shown in FIG. 6.
Figure 8:
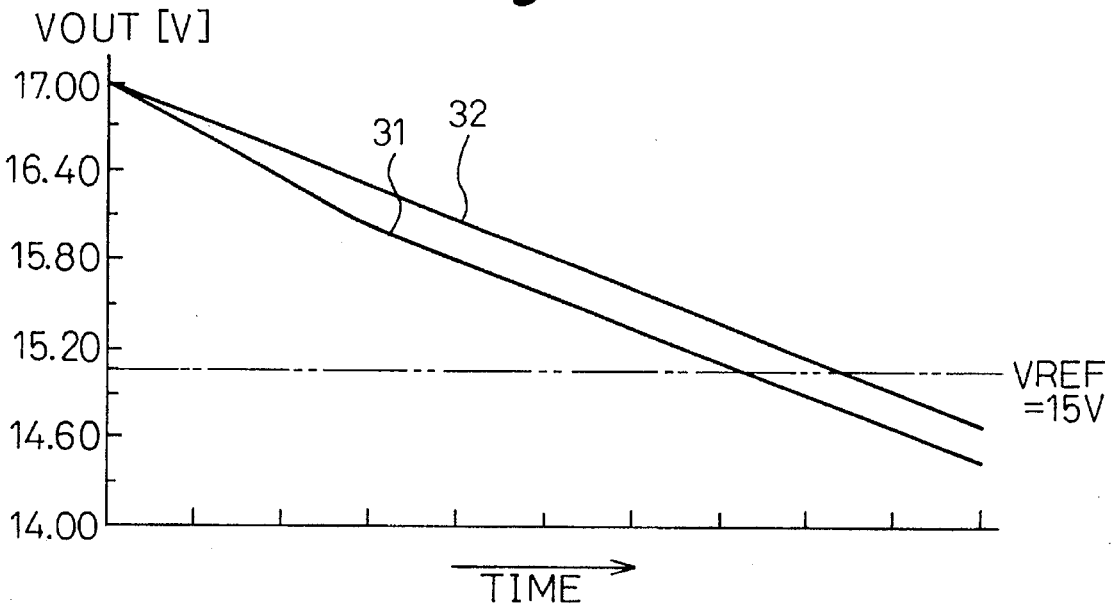
FIG. 8 is a diagram showing the voltage characteristics of the circuit shown in FIG. 6.

First embodiment . . . FIGS. 6 to 8

FIG. 6 shows the circuit constitution of the first embodiment of the present invention. In the drawing, reference numeral 22 denotes a voltage generation circuit which generates a positive voltage VDD1, such as 17V, at the time of non-load; 22A denotes a voltage output terminal of the voltage generation circuit 22; 23 is an internal resistance of the voltage generation circuit 22; 24 denotes a constant voltage supplying circuit; and 25 denotes a load resistor.

In the constant voltage supplying circuit, reference numerals 26 and 27 denote enhancement type p-MOS transistors, respectively, and reference numeral 28 denotes a resistor having a high resistance.

Here, the gate of the p-MOS transistor 26 is connected to its drain, and a reference voltage VREF1 having the same polarity as that of a voltage VDD1, which is output by the voltage generation circuit 22 at the time of non-load, but having a smaller absolute value than the voltage VDD1, such as 15V, is applied to the source of the p-MOS transistor 26.

The gate of the p-MOS transistor 27 is connected to the drain of the p-MOS transistor 26, its source is connected to the voltage output terminal 22A of the voltage generation circuit 22 and its drain is grounded.

The constant voltage supplying circuit 24 of this first embodiment stabilizes the voltage VD1 at the voltage output terminal 22A of the voltage generation circuit 22 to the same voltage value as the reference voltage VREF and supplies it as the output voltage VOUT to the load.

Here, assuming that the drain-source voltage of the p-MOS transistor 26 is $VDS_{26}$ and the gate-source voltage is $VGS_{26}$ and moreover, the threshold voltage of the p-MOS transistors is VTHp (negative voltage), the following equation is established:

$$VDS_{26}=VGS_{26}=VTHp$$

As a result, the gate voltage $VG_{27}$ of the p-MOS transistor 27 is given by $VG_{27}$=VREF1+VTHp, and the gate-source voltage $VGS_{27}$ of the p-MOS transistor 27 is given by $VGS_{27}=VG_{27}-VD1=(VREF1+VTHp)-VD1=(VREF1-VD1)+VTHp$.

In other words, since $VGS_{27}<VTHp$ as long as VD1>VREF1, the p-MOS transistor 27 keeps ON, and the current flows not only through the load resistor 25 but also through the p-MOS transistor 27, so that the voltage VD1 at the voltage output terminal 22A of the voltage generation circuit 22 drops. Since VGSz7 becomes equal to VTHp when VD1=VREF1, the p-MOS transistor 27 is turned OFF. Thereafter, the current flows only through the load resistor 25 and the voltage VD1 at the voltage output terminal 22A of the voltage generation circuit 22 keeps the same voltage value as the reference voltage VREF.

By the way, since the p-MOS transistor 26 drives the p-MOS transistor 27, the transistor size may be small.

If a capacitor 29 is connected in place of the voltage generation circuit 22 and after this capacitor 29 is charged to 17 V, the constant voltage supplying circuit 24 is operated as shown in FIG. 7, the voltage change of the output voltage VOUT supplied to the load resistor 25 is such as the one indicated by a solid line in FIG. 8. In FIG. 8, a solid line 32 represents the voltage change of the output voltage VOUT when the constant voltage supplying circuit 24 of the first embodiment is not connected and only the load resistor 25 is used.

As described above, the constant voltage supplying circuit 24 according to the first embodiment can stabilize the voltage VD1 at the voltage output terminal 22A of the voltage generation circuit 22 to the same voltage value as the reference voltage VREF1 irrespective of variance of the characteristics of the p-MOS transistors 26 and 27 and can supply it as the output voltage VOUT to the load.

Since the resistor 28 having a high resistance is interposed between the drain of the p-MOS transistor 26 and the ground, the drain voltage of the p-MOS transistor 26 can be stabilized to VREF1+VTHp and even when a noise is superposed with the reference voltage VERF, for example, the drain voltage is prevented from becoming unstable because a reverse bias is established between the drain of this p-MOS transistor 26 and the n-well at which this transistor 26 is formed.

Furthermore, because this constant voltage supplying circuit 24 can be constituted by the p-MOS transistors 26, 27 and the resistor 28, the increase of the production steps is not invited when this circuit is fabricated in the integrated circuit, and the production cost does not increase, either.

When the gate-source voltage VGS27 of the p-MOS transistor 27 approaches to the threshold voltage VTHp in the constant voltage supplying circuit 24 of this first embodiment, the drain current of the p-MOS transistor 27 decreases. As a result, the voltage VD1 at the voltage output terminal 22A of the voltage generation circuit 22 becomes difficult to drop, so that the time necessary for the voltage VD1 at the voltage output terminal 22A of the voltage generation circuit 22 to drop to the same voltage value as the reference voltage VREF1 gets prolonged, as much.

Such a problem cannot be effectively solved even by increasing the transistor size of the p-MOS transistor 27. The constant voltage supplying circuit of the second embodiment, which will be explained next, is directed to improve this problem.

Figure 9:
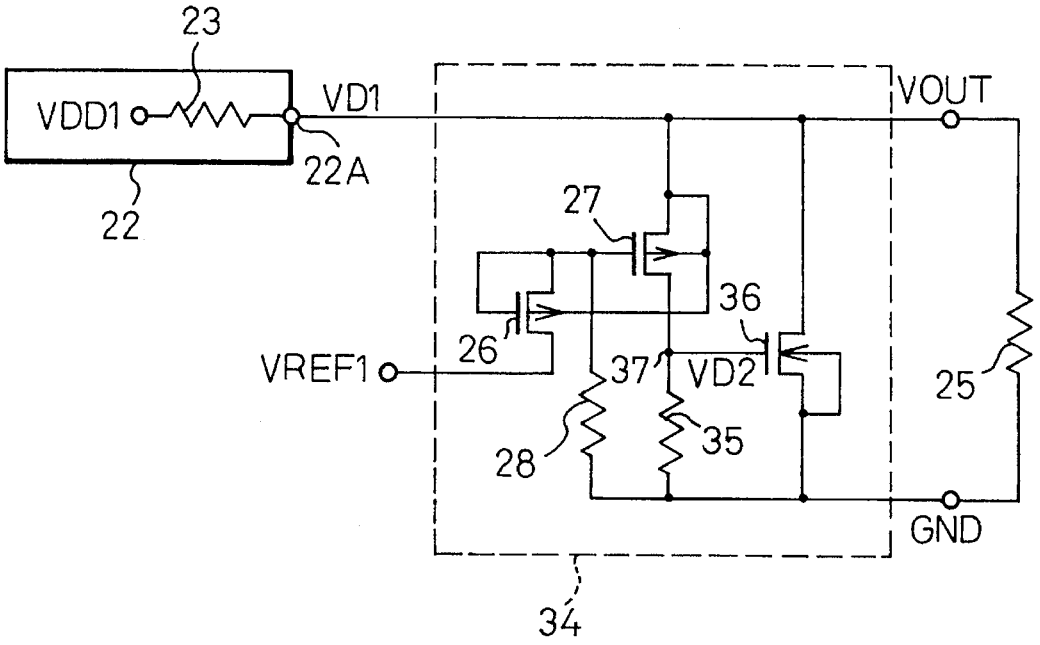
FIG. 9 is a circuit diagram showing the constitution of the constant voltage supplying circuit according to a second embodiment of the present invention.
Figure 10:
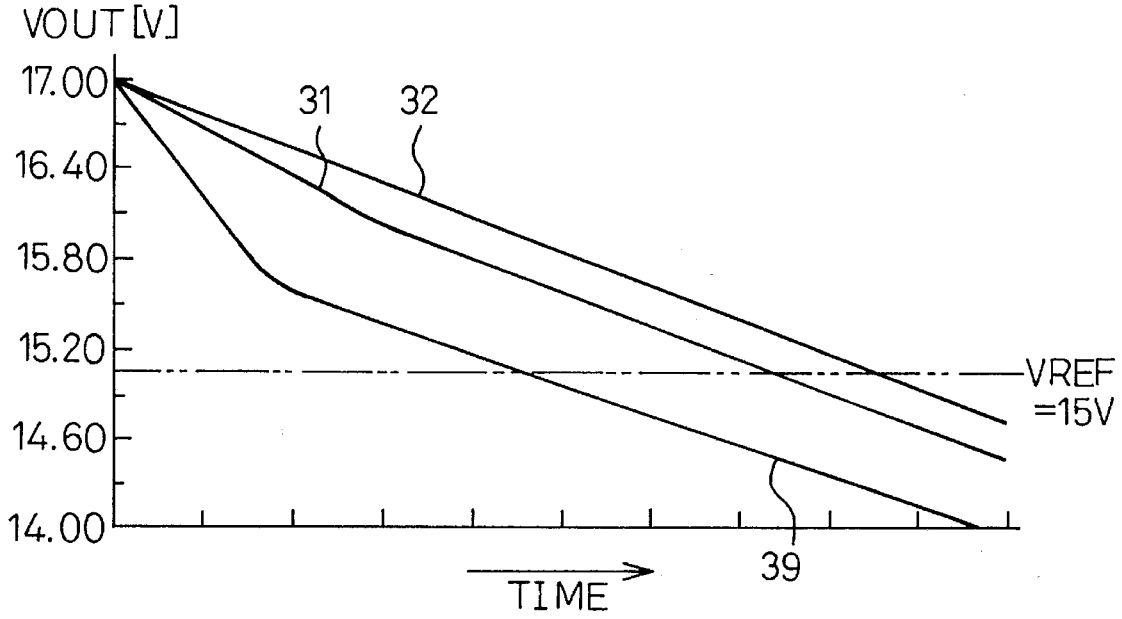
FIG. 10 is a diagram showing the voltage characteristics of the circuit shown in FIG. 9.

Second embodiment . . . FIGS. 9 and 10

FIG. 9 shows the circuit constitution according to the second embodiment of the present invention.

In the drawing, reference numeral 34 denotes a constant voltage supplying circuit according to the second embodiment. This constant voltage supplying circuit 34 includes a resistor 35 and an enhancement type n-MOS transistor 36. Since the rest of the circuit constitution are the same as those of the constant voltage supplying circuit 24 of the first embodiment shown in FIG. 6, its explanation will be omitted.

One of the ends of the resistor 35 is connected to the drain of the p-MOS transistor 27 and the other end is grounded. The gate of the n-MOS transistor 36 is connected to the drain of the p-MOS transistor 27, its drain is connected to the voltage output terminal 22A of the voltage generation circuit 22, and its source is grounded.

While the relation VD1>VRE1 is satisfied in the constant voltage supplying circuit 34 of this second embodiment, the current flows through the p-MOS transistor 27 in the same way as in the constant voltage supplying circuit 24 of the first embodiment. In this case, however, the voltage drop occurs in the resistor 35, and a certain voltage VD2 appears at a node 37.

Assuming that the gate-source voltage of the n-MOS transistor 36 is VGS36 and the threshold voltage of the n-MOS transistor is $VTH_n$, the n-MOS transistor 36 keeps the ON state as long as VD2>$VTH_n$ because VGS36=VD2.

Accordingly, the current flows through not only the load resistor 25 but also through the p-MOS transistor 27 and the n-MOS transistor 36, so that the voltage VD1 at the voltage output terminal 22A of the voltage generation circuit 22 drops.

Thereafter, the voltage VD2 of the node 37 becomes equal to $VTH_n$ before VD1=VREF1, and the n-MOS transistor 36 is turned OFF and the current does not flow any more through the n-MOS transistor 36. When the state where VD1=VREF1 is reached, $VGS_{27}$ becomes equal to VTHp. Accordingly, the p-MOS transistor 27 is turned OFF. Thereafter, the current flows through only the load resistor 25 and the voltage VD1 at the voltage output terminal 22A of the voltage generation circuit 22 keeps the same voltage value as the reference voltage VREF1.

By the way, the drop of the voltage VD1 at the voltage output terminal 22A of the voltage generation circuit 22 is exclusively generated by the n-MOS transistor 36. Therefore, the transistor size of the p-MOS transistor 27 may be small.

In the circuit shown in FIG. 7, if the constant voltage supplying circuit 34 shown in the second embodiment is connected in place of the constant voltage supplying circuit 24 of the first embodiment and after the capacitor 29 is charged to 17V, the constant voltage supplying circuit 34 of the second embodiment is operated, the voltage change of the output voltage VOUT supplied to the load resistor 25 is indicated by a solid line 39 shown in FIG. 10. Incidentally, in FIG. 10, a solid line 32 represents the voltage change of the output voltage VOUT when only the load resistor 25 is used, and a solid line 31 represents the change of the output voltage VOUT when the constant voltage supplying circuit 24 of the first embodiment is connected.

As described above, the constant voltage supplying circuit 34 according to the second embodiment can stabilize the voltage VD1 at the voltage output terminal 22A of the voltage generation circuit 22 to the same voltage value as the reference voltage VREF1 irrespective of variance of the characteristics of the p-MOS transistors 26, 27 and the n-MOS transistor 36, and can supply it as the output voltage VOUT to the load.

Since the resistor 28 having a high resistance is interposed between the drain of the p-MOS transistor 26 and the ground, the drain voltage of the p-MOS transistor 26 is stabilized to VREF1+VTHp. Even when a noise is superposed with the reference voltage VREF1, for example, a reverse bias is established between the drain of the p-MOS transistor 26 and the n-well at which this transistor 26 is formed, so that the drain voltage of the p-MOS transistor 26 is prevented from becoming unstable.

Because the constant voltage supplying circuit 34 of this second embodiment includes the resistor 35 and the n-MOS transistor 36, it can stabilize the voltage VD1 at the voltage output terminal 22A of the voltage generation circuit 22 more quickly than in the constant voltage supplying circuit 24 of the first embodiment.

Further, the constant voltage supplying circuit 34 of this second embodiment can be constituted by the p-MOS transistors 26, 27, the resistor 35 and the n-MOS transistor 36. Therefore, when the circuit 34 is fabricated in the integrated circuit, the increase of the production steps is not invited, and the production cost does not increase, either.

When the voltage VD2 at the node 37 reaches the state of VD2=$VTH_n$ in the constant voltage supplying circuit 34 of this second embodiment, the n-MOS transistor 36 is turned OFF, and the current path becomes only a series circuit comprising the p-MOS transistor 27 having a high resistance and the resistor 35, besides the load resistor 25. As a result, the voltage VD1 at the voltage output terminal 22A of the voltage generation circuit 22 becomes thereafter difficult to drop, and the time necessary for the voltage VD1 at the voltage output terminal 22A of the voltage generation circuit 22 to drop to the same voltage value as the reference voltage VREF1 becomes prolonged.

The constant voltage supplying circuit of the third embodiment, which will be explained next, is directed to improve this problem.

Figure 11:
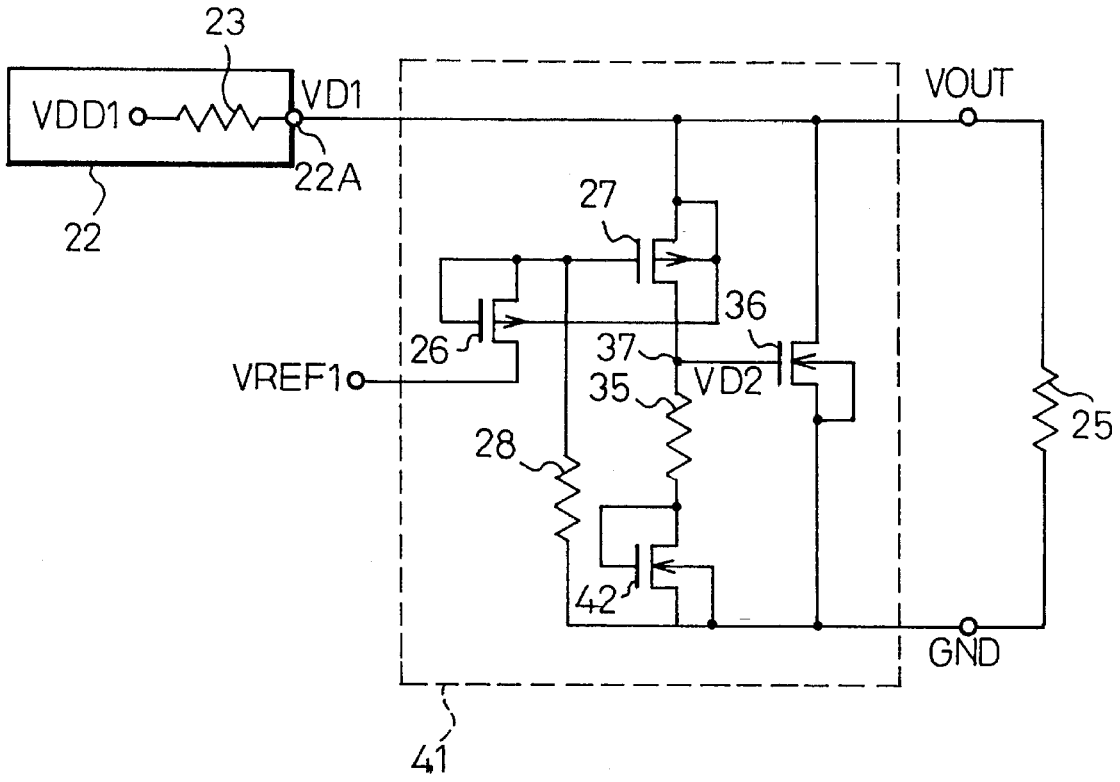
FIG. 11 is a circuit diagram showing the constitution of the constant voltage supplying circuit according to a third embodiment of the present invention.
Figure 12:
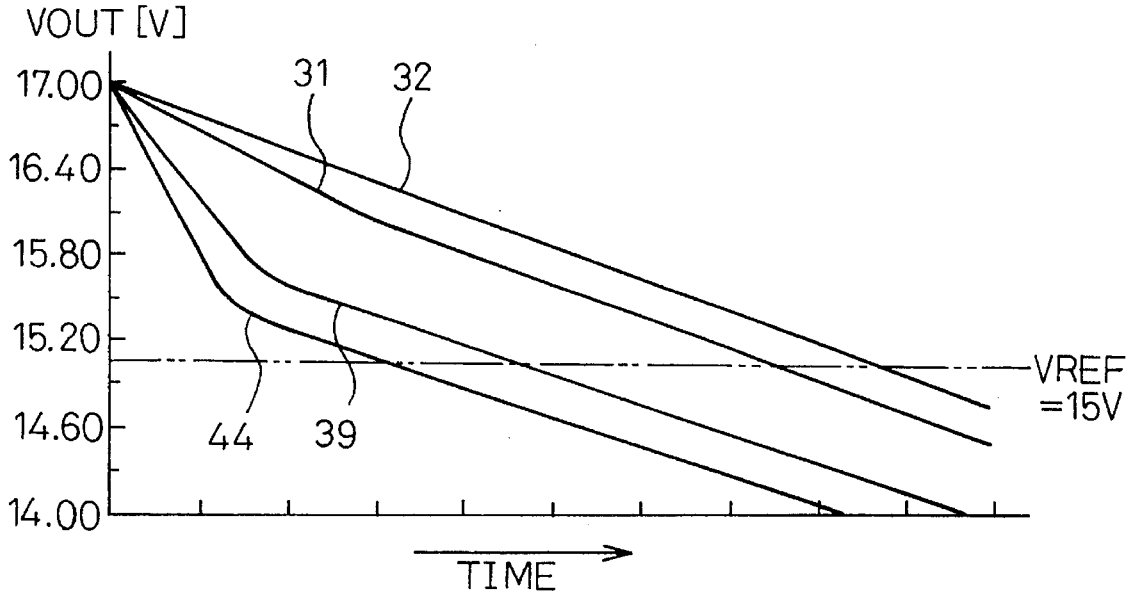
FIG. 12 is a diagram showing the voltage characteristics of the circuit shown in FIG. 11.

Third embodiment . . . FIGS. 11 and 12

FIG. 11 shows the circuit constitution of the third embodiment of the present invention.

In the drawing, reference numeral 41 denotes the constant voltage supplying circuit according to the third embodiment. This constant voltage supplying circuit includes an enhancement type n-MOS transistor 42. Since the rest of the circuit constitution are the same as those of the constant voltage supplying circuit 34 of the second embodiment, its explanation will be omitted.

The gate of the n-MOS transistor 42 is connected to its drain, this drain is connected to the drain of the p-MOS transistor 27 through the resistor 35, and the source of the n-MOS transistor 42 is grounded.

Assuming that the drain-source voltage of the n-MOS transistor 42 is $VDS_{42}$ and the gate-source voltage is $VGS_{42}$ in the constant voltage supplying circuit 41 of the third embodiment, the relation $VDS_{42}=VGS_{42}\geqq VTH_n$ is maintained as long as the current flows, and the voltage VD2 at the node 37 always satisfies the relation VD2$\geqq VTH_n$. As a result, the n-MOS transistor 36 is not turned OFF before the p-MOS transistor 27, and the n-MOS transistor 36 continues to flow the current until the voltage VD1 at the voltage output terminal 22A of the voltage generation circuit 22 reaches the same voltage value as that of the reference voltage VREF1.

By the way, since the n-MOS transistor 36 exclusively lowers the voltage VD1 at the voltage output terminal 22A of the voltage generation circuit 22 in this third embodiment, both the p-MOS transistor 27 and the n-MOS transistor 42 may have a small transistor size.

Here, when the constant voltage supplying circuit 41 of the third embodiment is connected in place of the constant voltage supplying circuit 24 of the first embodiment and after the capacitor 29 is charged to 17 V, the constant voltage supplying circuit 41 of the third embodiment 41 is operated in the circuit shown in FIG. 7, the change of the output voltage VOUT supplied to the load resistor 25 is indicated by a solid line 44 in FIG. 12. Incidentally, a solid line 32 in FIG. 12 represents the voltage change of the output voltage VOUT when the constant voltage supplying circuit is not used but only the load resistor 25 is used, and a solid line 31 represents the voltage change of the output voltage VOUT when the constant voltage supplying circuit 24 of the first embodiment is connected. A solid line 39 represents the change of the output voltage VOUT when the constant voltage supplying circuit 34 of the second embodiment is connected.

As described above, the constant voltage supplying circuit 41 according to the third embodiment can stabilize the voltage VD1 at the voltage output terminal 22A of the voltage generation circuit 22 to the same voltage value as the reference voltage VREF1 irrespective of variance of the characteristics of the p-MOS transistors 26, 27 and the n-MOS transistors 36, 42 and can supply it as the output voltage VOUT to the load.

Since the resistor 28 having a high resistance is interposed between the drain and the ground of the p-MOS transistor 26, the drain voltage of the p-MOS transistor 26 is stabilized to VREF1+VTHp, and even when a noise is superposed with the reference voltage VREF1, for example, a reverse bias is established between the drain of this p-MOS transistor 26 and the n-well at which this transistor 26 is formed, so that the drain voltage of the p-MOS transistor 26 is prevented from becoming unstable.

Since the constant voltage supplying circuit 41 of this third embodiment includes the n-MOS transistor 42, it can stabilize the voltage VD1 at the voltage output terminal 22A of the voltage generation circuit 22 more quickly than the constant voltage supplying circuit 34 of the second embodiment.

Further, the constant voltage supplying circuit 41 of the third embodiment can be constituted by the p-MOS transistors 26, 27, the resistor 35 and the n-MOS transistors 36, 42. Therefore, even when the constant voltage supplying circuit is fabricated in the integrated circuit, it does not invite the increase of the production steps and does not increase the production cost, either.

Figure 13:
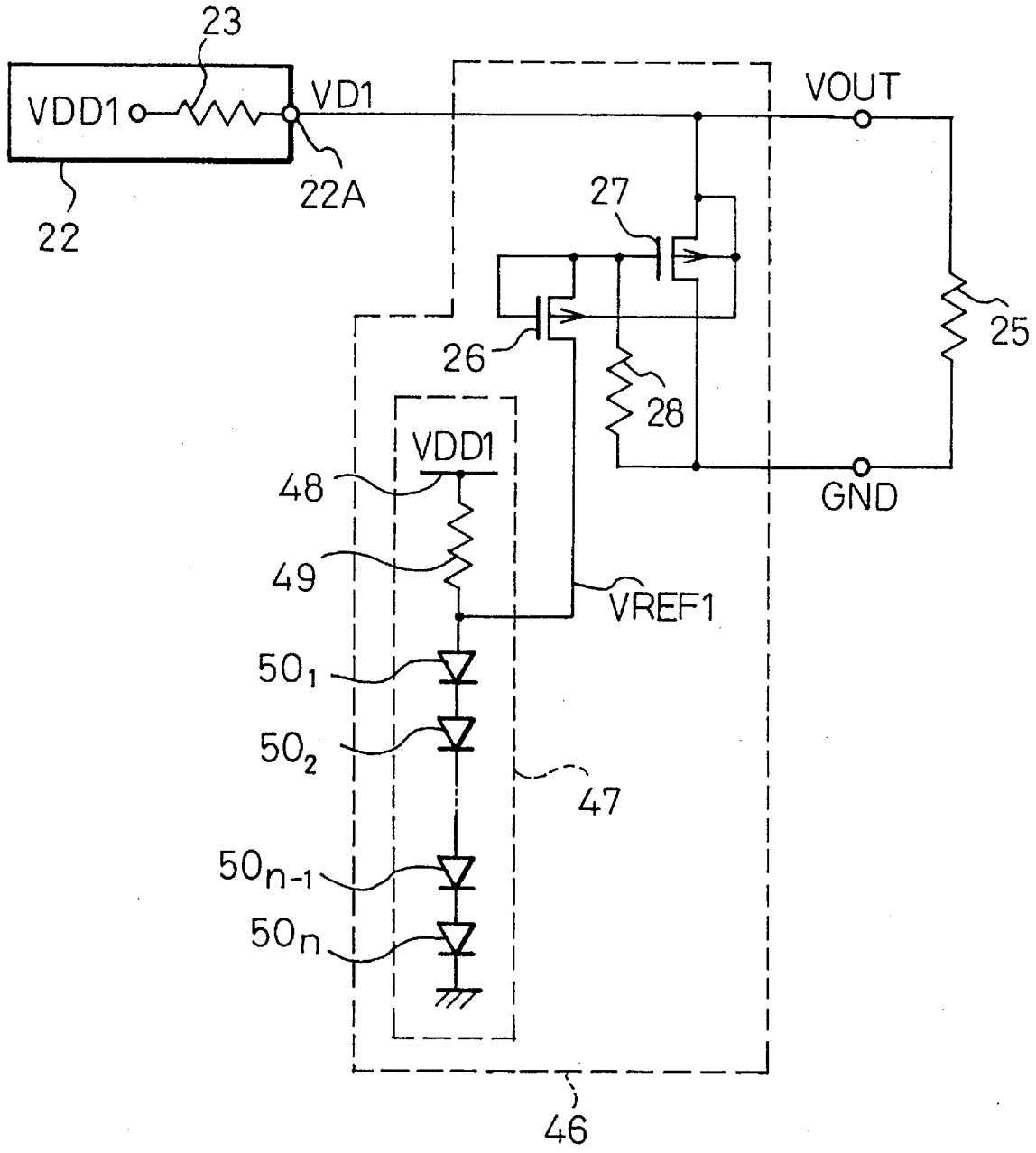
FIG. 13 is a circuit diagram showing the constitution of the constant voltage supplying circuit according to a fourth embodiment of the present invention.

Fourth embodiment . . . FIG. 13

FIG. 13 shows the circuit constitution of the fourth embodiment of the present invention.

In the drawing, reference numeral 46 denotes the constant voltage supplying circuit according to the second embodiment. This constant voltage supplying circuit 46 includes a built-in reference voltage generation circuit 47 for generating a reference voltage VREF1. Since the rest of the circuit constitution are the same as those of the constant voltage supplying circuit 24 of the first embodiment shown in FIG. 6, its explanation will be omitted.

In the reference voltage generation circuit 47, reference numeral 48 denotes a power supply line for supplying a voltage VDD1; 49 denotes a resistor; and $50_1$ to $50_n$ denote diodes, respectively. This reference voltage generation circuit 47 shifts the level of the voltage VDD1 and obtains the reference voltage VREF1.

As described above, the constant voltage supplying circuit 46 according to the fourth embodiment can stabilize the voltage VD1 at the voltage output terminal 22A of the voltage generation circuit 22 to the same voltage value as the reference voltage VREF1 irrespective of variance of the characteristics of the p-MOS transistors 26, 27 and can supply it as the output voltage VOUT to the load, in the same way as the constant voltage supplying circuit 24 of the first embodiment shown in FIG. 6.

Since the resistor 28 having a high resistance is interposed between the drain and the ground of the p-MOS transistor 26, the drain voltage of the p-MOS transistor 26 can be stabilized to VREF1+VTHp and even when a noise is superposed, for example, a reverse bias is established between the drain of the p-MOS transistor 26 and the n-well at which this p-MOS transistor 26 is formed, and the drain voltage of the p-MOS transistor 26 is prevented from becoming unstable.

Further, since the constant voltage supplying circuit 46 of the fourth embodiment can be constituted by the p-MOS transistors 26, 27, the resistor 49 and the diodes $50_1$ to $50_n$, it does not invite the increase of the production steps and does not increase the production cost, either, even when it is fabricated in the integrated circuit.

Figure 14:
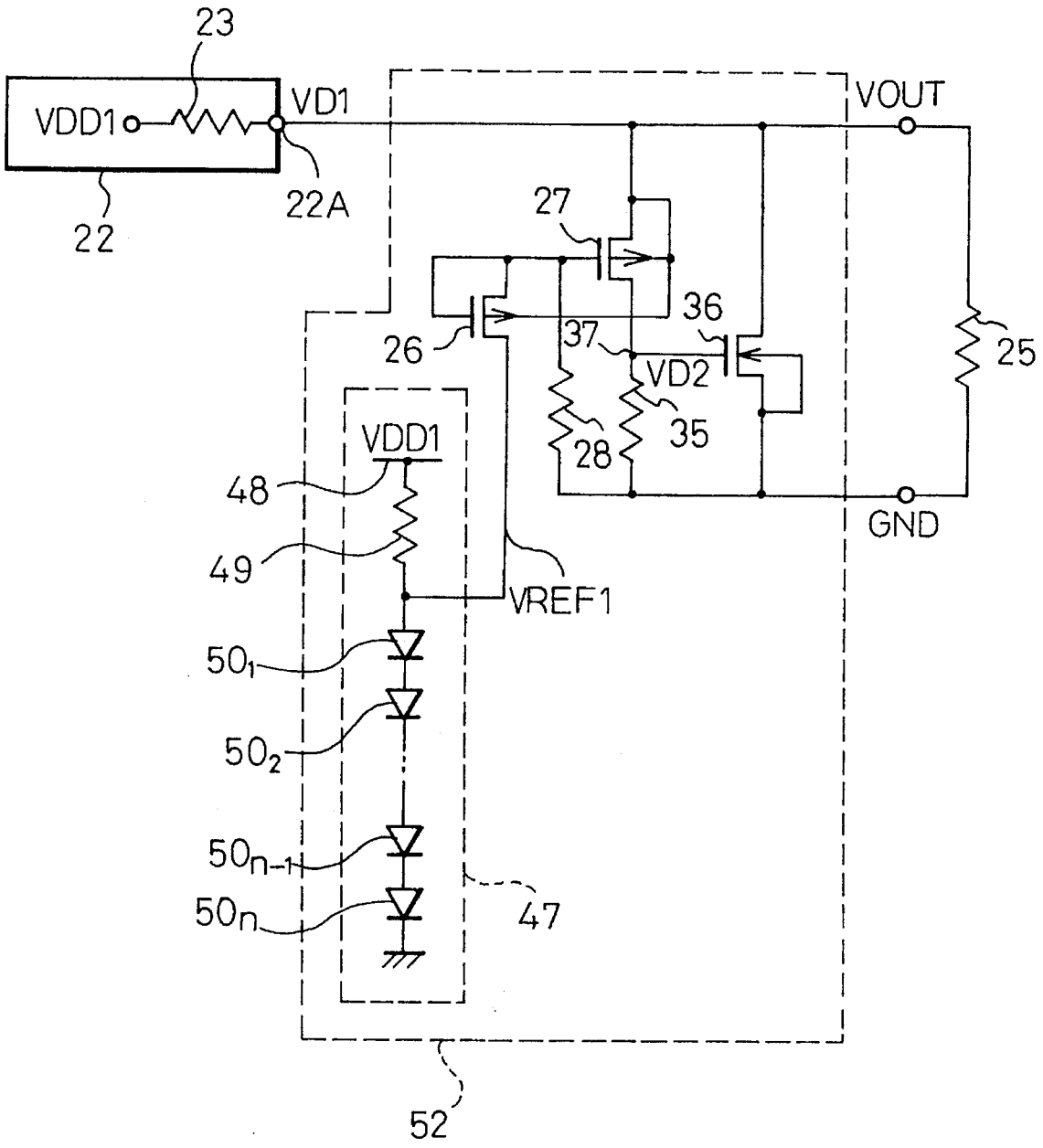
FIG. 14 is a circuit diagram showing the constitution of the constant voltage supplying circuit according to a fifth embodiment of the present invention.

Fifth embodiment . . . FIG. 14

FIG. 14 shows the circuit constitution of the fifth embodiment of the present invention.

In the drawing, reference numeral 52 denotes the constant voltage supplying circuit according to the fifth embodiment. This constant voltage supplying circuit 46 includes a built-in reference voltage generation circuit 47 in the same way as the constant voltage supplying circuit 46 of the fourth embodiment shown in FIG. 13. Since the rest of the circuit constitution are the same as those of the constant voltage supplying circuit 34 of the second embodiment shown in FIG. 9, its explanation will be omitted.

As described above, the constant voltage supplying circuit 52 of the fifth embodiment can stabilize the voltage VD1 at the voltage output terminal 22A of the voltage generation circuit 22 to the same voltage value as the reference voltage VREF1 irrespective of variance of the characteristics of the p-MOS transistors 26, 27 and the n-MOS transistor 36, and can supply it as the output voltage VOUT to the load, in the same way as the constant voltage supplying circuit 34 of the second embodiment shown in FIG. 9.

Since the resistor 28 having a high resistance is interposed between the drain of the p-MOS transistor 26 and the ground, the drain voltage of the p-MOS transistor 26 is stabilized to VREF1+VTHp. Even when a noise is superposed with the reference voltage VREF1, for example, a reverse bias is established between the drain of the p-MOS transistor 26 and the n-well at which this transistor 26 is formed, so that the drain voltage of the p-MOS transistor 26 is prevented from becoming unstable.

The constant voltage supplying circuit 52 of this fifth embodiment is equipped with the resistor 35 and the n-MOS transistor 36 in the same way as the constant voltage supplying circuit 34 of the second embodiment shown in FIG. 9. Therefore, stabilization of the voltage VD1 at the voltage output terminal 22A of the voltage generation circuit 22 can be made within a shorter time than the constant voltage supplying circuit 46 of the fourth embodiment shown in FIG. 13.

Further, the constant voltage supplying circuit 52 of this fifth embodiment can be constituted by the p-MOS transistors 26, 27, the resistors 35, 49, the n-MOS transistor 36 and the diodes $50_1$ to $50_n$. Therefore, even when this circuit 52 is fabricated in the integrated circuit, it does not invite the production steps and does not either increase the production cost.

Figure 15:
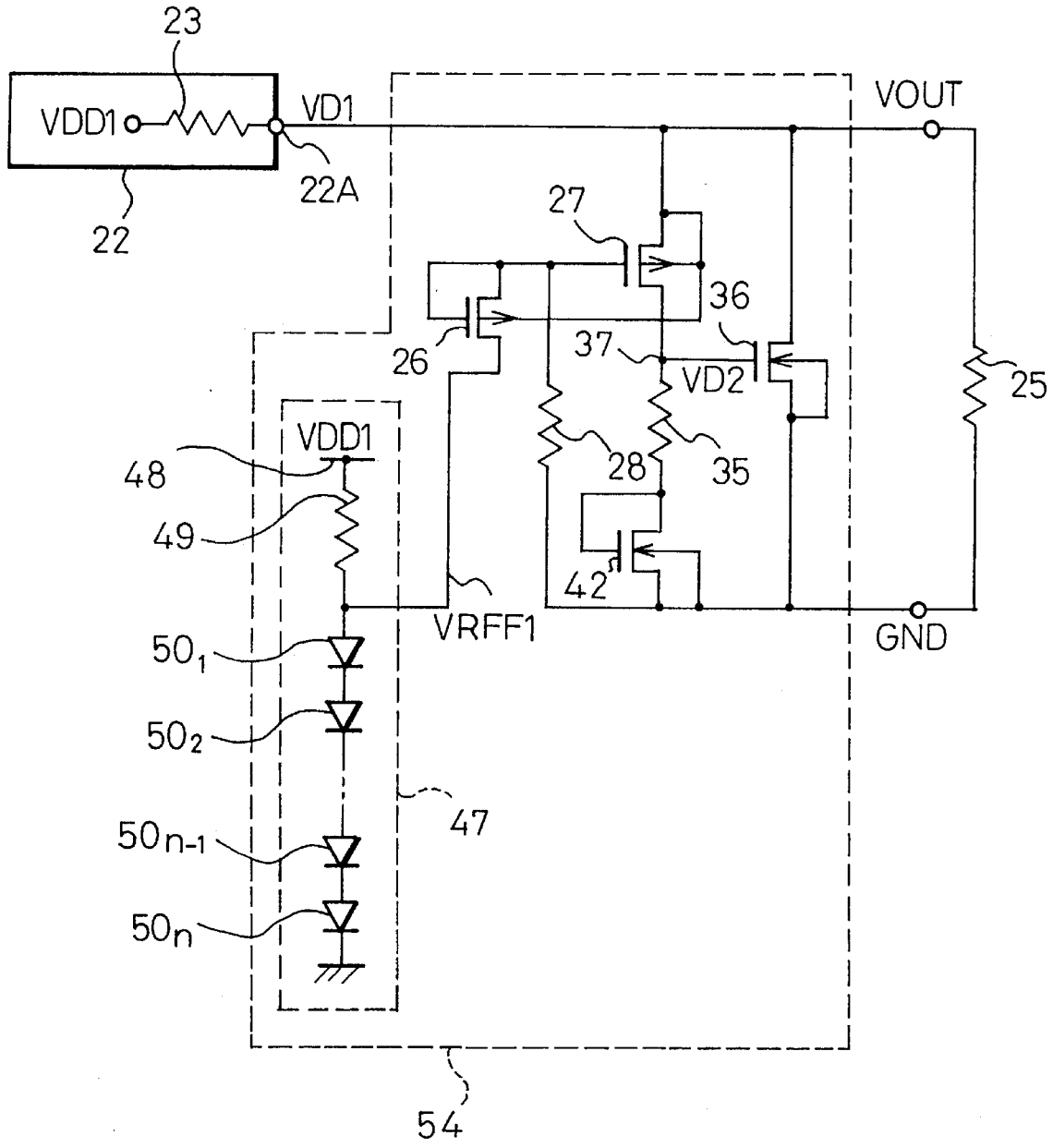
FIG. 15 is a circuit diagram showing the constitution of the constant voltage supplying circuit according to a sixth embodiment of the present invention.

Sixth embodiment . . . FIG. 15

FIG. 15 shows the circuit constitution of the sixth embodiment of the present invention.

In the drawing, reference numeral 54 denotes a constant voltage supplying circuit according to the sixth embodiment. This constant voltage supplying circuit 54 includes a built-in reference voltage generation circuit 47 in the same way as the constant voltage supplying circuit 52 of the fifth embodiment shown in FIG. 14. Since the rest of the circuit constitution are the same as those of the constant voltage supplying circuit 41 shown in FIG. 11, the explanation will be omitted.

As described above, the constant voltage supplying circuit 54 according to the sixth embodiment can stabilize the voltage VD1 at the voltage output terminal 22A of the voltage generation circuit 22 to the same voltage value as the reference voltage VREF1 irrespective of variance of the characteristics of the p-MOS transistors 26, 27 and the n-MOS transistors 36, 42 and can supply it as the output voltage to the load in the same way as the constant voltage supplying circuit 41 of the third embodiment shown in FIG. 11.

Further, since the resistor 28 having a high resistance is interposed between the drain of the p-MOS transistor 26 and the ground, the drain voltage of the p-MOS transistor 26 is stabilized to VREF1+VTHp, and even when a noise is superposed with the reference voltage VREF1, for example, a reverse bias is established between the drain of the p-MOS transistor 26 and the n-well at which this p-MOS transistor 26 is formed, so that the drain voltage of the p-MOS transistor 26 is prevented from becoming unstable.

Further, since the constant voltage supplying circuit 54 of this sixth embodiment is equipped with the n-MOS transistor 42 in the same way as the constant voltage supplying circuit 41 of the third embodiment shown in FIG. 11, stabilization of the voltage VD1 at the voltage output terminal 22A of the voltage generation circuit 22 can be made within a shorter time than the constant voltage supplying circuit 52 of the fifth embodiment shown in FIG. 14.

Further, since the constant voltage supplying circuit 54 of this sixth embodiment can be constituted by the p-MOS transistors 26, 27, the resistors 35, 49, the n-MOS transistors 36, 42 and the diodes $50_1$ to $50_n$, it does not invite the increase of the production steps when it is fabricated in the integrated circuit, and does not either increase the production cost.

Figure 16:
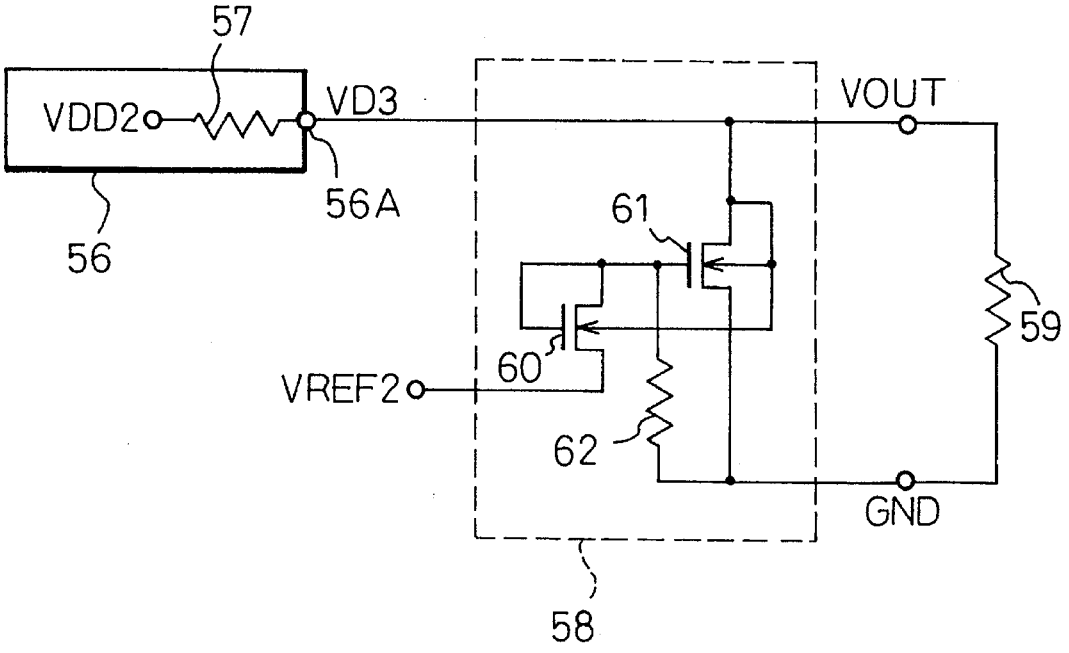
FIG. 16 is a circuit diagram showing the constitution of the constant voltage supplying circuit according to a seventh embodiment of the present invention.

Seventh embodiment . . . FIG. 16

FIG. 16 shows the circuit constitution of the seventh embodiment of the present invention.

In the drawing, reference numeral 56 denotes a voltage generation circuit which generates a negative voltage VDD2 at the time of non-load, such as −17 V; 56A denotes voltage output terminal of the voltage generation circuit 56; 57 denotes an internal resistance of the voltage generation circuit 56; 58 denotes a constant voltage supplying circuit; and 59 denotes a load resistor.

In the constant voltage supplying circuit 58, reference numerals 60 and 61 denote enhancement type n-MOS transistors, respectively, and reference numeral 62 denotes a resistor having a high resistance.

The gate of the n-MOS transistor 60 is connected to its drain, and a reference voltage VREF2, which has the same polarity as the voltage VDD2 output by the voltage generation circuit 56 at the time of non-load, and has a smaller absolute value than the voltage VDD2, such as −15 V, is supplied to the source of this n-MOS transistor 60. The gate of the n-MOS transistor 61 is connected to the drain of the non-MOS transistor 60, its source is connected to the voltage output terminal 56A of the voltage generation circuit 56, and its drain is grounded.

The constant voltage supplying circuit 58 stabilizes the voltage VD3 at the voltage output terminal 56A of the voltage generation circuit 56 to the same voltage value as the reference voltage VREF2 and supplies it as the output voltage VOUT to the load resistor 59.

Assuming that the drain-source voltage of the n-MOS transistor 60 is VDS60 and its gate-source voltage is $VGS_{60}$, $VDS_{60}=VGS_{60}=VTH_n$. As a result, the gate voltage $VG_{61}$, of the n-MOS transistor 61 becomes $VG_{61}$=VREF2+VTHn, and the gate-source voltage of the n-MOS transistor 61 is given by $VGS_{61}=VG_{61}-VD\ 3$=(VREF2+VTHn)−VD3=(VREF2−VD3)+VTHn.

In other words, as long as VD3<VREF2, $VGS_{61}$>VTHn. Accordingly, the n-MOS transistor 61 keeps the ON state, and the current flows not only through the load resistor 59 but also through the n-MOS transistor 61, so that the voltage VD3 at the voltage output terminal 56A of the voltage generation circuit 56 rises. At the point when VD3 becomes equal to VREF2, $VGS_{61}$=VTHn. Therefore, the n-MOS transistor 61 is turned OFF and thereafter, the current flows only through the load resistor 59 and the voltage VD3 at the voltage output terminal 56A of the voltage generation circuit 56 keeps the same voltage value as the reference voltage VREF2.

By the way, since the n-MOS transistor 60 is directed to drive the n-MOS transistor 61, its transistor size may be small.

As described above, the constant voltage supplying circuit 58 according to the seventh embodiment stabilizes the voltage VD3 at the voltage output terminal 56A of the voltage generation circuit 56 to the same voltage value as the reference voltage VREF2, and can supply it as the output voltage VOUT to the load.

Since the resistor 62 having a high resistance is interposed between the drain of the n-MOS transistor 60 and the ground, the drain voltage of the n-MOS transistor 60 is stabilized to VREF2+VTHn and even when a noise is superposed with the reference voltage VREF2, for example, a reverse bias is established between the drain of the n-MOS transistor 60 and the p-well at which this transistor 60 is formed, so that the drain voltage of the n-MOS transistor 60 is prevented from becoming unstable.

Further, since the constant voltage supplying circuit 58 of this seventh embodiment can be constituted by the n-MOS transistors 60, 61, it does not invite the increase of the production steps even when it is fabricated in the integrated circuit, and does not either increase the production cost.

In this seventh embodiment, when the gate-source voltage $VGS_{61}$ of the n-MOS transistor 61 approaches the threshold voltage VTHn, the drain current of the n-MOS transistor 61 decreases. As a result, the VD3 at the voltage output terminal 56A of the voltage generation circuit 56 becomes difficult to rise, and the time before the voltage VD3 at the voltage output terminal 56A of the voltage generation circuit 56 reaches the same voltage as the reference voltage VREF2 becomes longer.

Such a problem cannot be effectively solved even by increasing the transistor size of the n-MOS transistor 61. The constant current supplying circuit of the eighth embodiment, which will be explained next, is directed to improve this problem.

Figure 17:
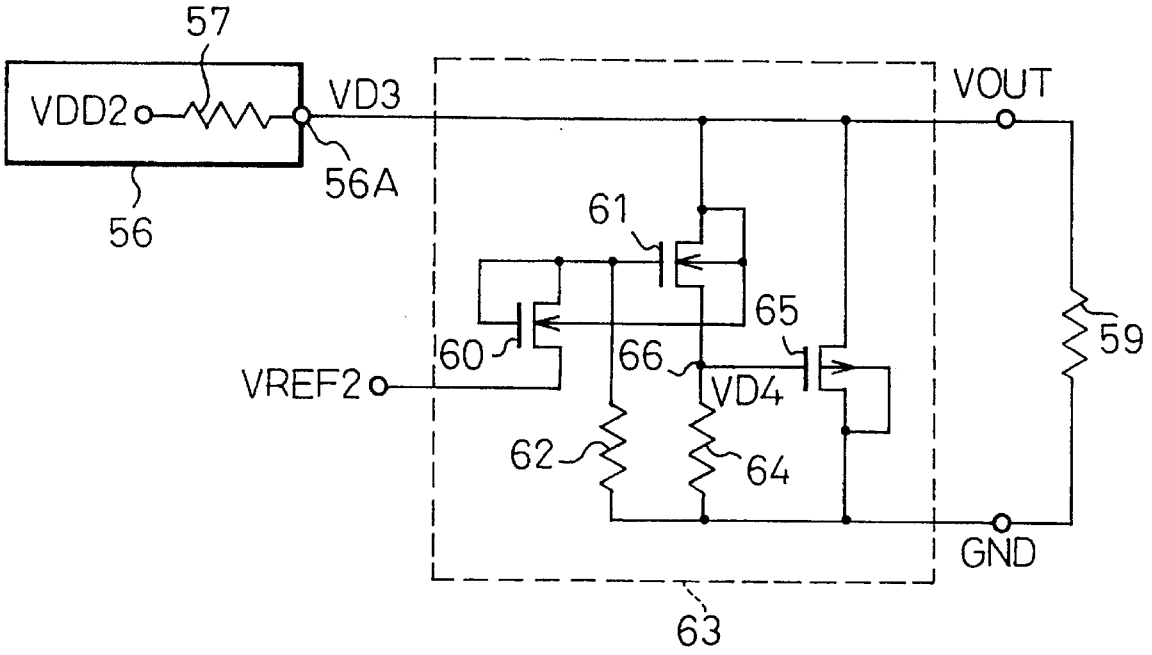
FIG. 17 is a circuit diagram showing the constitution of the constant voltage supplying circuit according to an eighth embodiment of the present invention.

Eighth embodiment . . . FIG. 17

FIG. 17 shows the circuit constitution of the eighth embodiment of the present invention.

In the drawing, reference numeral 63 denotes a constant voltage supplying circuit according to the eighth embodiment. This constant voltage supplying circuit 63 includes a resistor 64 and an enhancement type p-MOS transistor 65. Since the rest of the circuit constitution are the same as those of the constant voltage supplying circuit 58 of the seventh embodiment shown in FIG. 16, the explanation will be omitted.

One of the ends of the resistor 64 is connected to the drain of the n-MOS transistor 61 and the other end is grounded. The gate of the p-MOS transistor 65 is connected to the drain of the n-MOS transistor 61, its drain is connected to the voltage output terminal 56A of the voltage generation circuit 56, and its source is grounded.

According to this eighth embodiment, as long as VD3<VREF2, the current flows through the n-MOS transistor 61 in the same way as in the constant voltage supplying circuit 58 of the seventh embodiment, but in this case, the voltage drop occurs in the resistor 64 and a certain voltage VD4 appears at the node 66. Assuming that the gate-source voltage of the p-MOS transistor 65 is $VGS_{65}$, the p-MOS transistor 65 keeps the ON state while VD4<VTHp because $VGS_{65}$=VD4.

Accordingly, the current flows not only through the load resistor 59 but also through the n-MOS transistor 61 and the p-MOS transistor 65, so that the voltage VD3 at the voltage output terminal 56A of the voltage generation circuit 56 rises.

Thereafter, the voltage VD4 becomes equal to VTHp before VD3 =VREF2, and the p-MOS transistor 65 is turned OFF and the current no longer flows through this p-MOS transistor 65.

When VD3 becomes equal to VREF2, the n-MOS transistor 61 is turned OFF because $VGS_{61}$=VTHn, and the current thereafter flows only through the load resistor 59, so that the voltage VD3 at the voltage output terminal 56A of the voltage generation circuit 56 keeps the same voltage as the reference voltage VREF2.

In this eighth embodiment, the drop of the voltage VD3 at the voltage output terminal 56A of the voltage generation circuit 56 is solely effected by the p-MOS transistor 65. Accordingly, the transistor size of the n-MOS transistor 61 may be small.

As described above, the constant voltage supplying circuit 63 according to the eighth embodiment stabilizes the voltage VD3 at the voltage output terminal 56A of the voltage generation circuit 56 to the same voltage value as the reference voltage VREF2 irrespective of variance of the characteristics of the n-MOS transistors 60, 61 and the p-MOS transistor 65 and can supply it as the output voltage VOUT to the load.

Since the resistor 62 having a high resistance is interposed between the drain of the n-MOS transistor 60 and the ground, the drain voltage of the n-MOS transistor 60 is stabilized to VREF2+VTHn, and even when a noise is superposed with the reference voltage VREF2, for example, a reverse bias is established between the drain of the n-MOS transistor 60 and the p-well at which this n-MOS transistor 60 is formed, so that the drain voltage of the n-MOS. transistor 60 is prevented from becoming unstable.

Since the constant voltage supplying circuit 63 of this eighth embodiment includes the resistor 64 and the p-MOS transistor 65, stabilization of the voltage VD3 at the voltage output terminal 56A of the voltage generation circuit 56 can be made within a shorter time than in the constant voltage supplying circuit 58 of the seventh embodiment.

Since the constant voltage supplying circuit 63 of this eighth embodiment can be constituted by the n-MOS transistors 60, 61, the resistor 64 and the p-MOS transistor 65, it does not invite the increase of the production steps when it is fabricated in the integrated circuit and does not either increase the cost of production.

By the way, in this eighth embodiment, when the voltage VD4 at the node 66 becomes equal to VTHp, the p-MOS transistor 65 is turned OFF, and the current path becomes solely the series circuit consisting of the n-MOS transistor 61 and the resistor 64 and having a high resistance besides the load resistor 59. As a result, the voltage VD3 at the voltage output terminal 56A of the voltage generation circuit 56 becomes thereafter difficult to rise, and the time before the voltage VD3 at the voltage output terminal 56A of the voltage generation circuit 56 reaches the same voltage value as the reference voltage VREF2 becomes prolonged.

The constant voltage supplying circuit of the ninth embodiment, which will be explained next, is directed to improve this problem.

Figure 18:
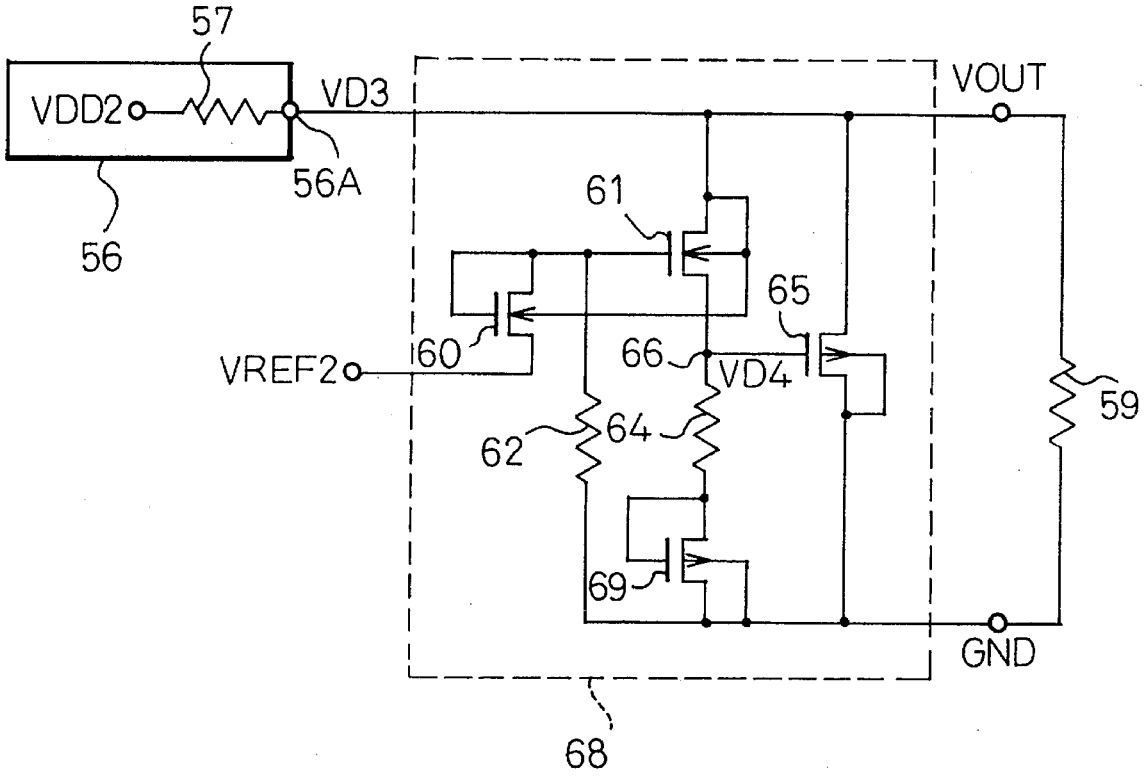
FIG. 18 is a circuit diagram showing the constitution of the constant voltage supplying circuit according to a ninth embodiment of the present invention.

Ninth embodiment . . . FIG. 18

FIG. 18 shows the circuit constitution of the ninth embodiment of the present invention.

In the drawing, reference numeral 68 denotes a constant voltage generation circuit according to the ninth embodiment. This constant voltage supplying circuit 68 includes an enhancement type p-MOS transistor 69. Since the rest of the circuit constitution are the same as those of the constant voltage supplying circuit of the eighth embodiment shown in FIG. 17, the explanation will be omitted.

The gate of the p-MOS transistor 69 is connected to its drain, the drain is connected to the drain of the n-MOS transistor 61 through the resistor 64, and the source is grounded.

Assuming that the drain-source voltage of the p-MOS transistor 69 and its gate-source voltage are VDS69 and $VGS_{69}$, respectively, in the constant voltage supplying circuit 68 of this ninth embodiment, $VDS_{69}=VGS_{69}\leqq VTHp$ as long as the current flows, and the voltage VD4 at the node 66 is always VD4≦VTHp. As a result, the p-MOS transistor 65 is not turned OFF earlier than the n-MOS transistor 61, and the p-MOS transistor 65 continues to pass the current until the voltage VD3 at the voltage output terminal 56A of the voltage generation circuit 56 reaches the same voltage value as the reference voltage VREF2.

In this ninth embodiment, the p-MOS transistor 65 exclusively raises the voltage VD3 at the voltage output terminal 56A of the voltage generation circuit 56. Therefore, the transistor size of the n-MOS transistor 61 and the p-MOS transistor 69 may be small.

As described above, the constant voltage supplying circuit 68 according to the ninth embodiment stabilizes the voltage VD3 at the voltage output terminal 56A of the voltage generation circuit 56 to the same voltage value as the reference voltage VREF2 irrespective of variance of the characteristics of the n-MOS transistors 60, 61 and the p-MOS transistors 65, 69 and can supply it as the output voltage VOUT to the load.

Since the resistor 62 having a high resistance is interposed between the drain of the n-MOS transistor 60 and the ground, the drain voltage of the n-MOS transistor 60 is stabilized to VREF2+VTHn, and even when a noise is superposed with the reference voltage VREF2, for example, a reverse bias is established between the drain of the n-MOS transistor 60 and the p-well at which this transistor 60 is formed, so that the drain voltage of the n-MOS transistor 60 is prevented from becoming unstable.

Since the constant voltage supplying circuit 68 of this ninth embodiment is equipped with the p-MOS transistor 69, stabilization of the voltage VD3 at the voltage output terminal 56A of the voltage generation circuit 56 can be made within a shorter time than in the constant voltage supplying circuit 63 of the eighth embodiment.

Further, since the constant voltage supplying circuit 68 of the ninth embodiment can be constituted by the n-MOS transistors 60, 61, the resistor 64 and the p-MOS transistors 65, 69, it does not invite the increase of the production steps when it is fabricated in the integrated circuit, and does not either increase the cost of production.

Figure 19:
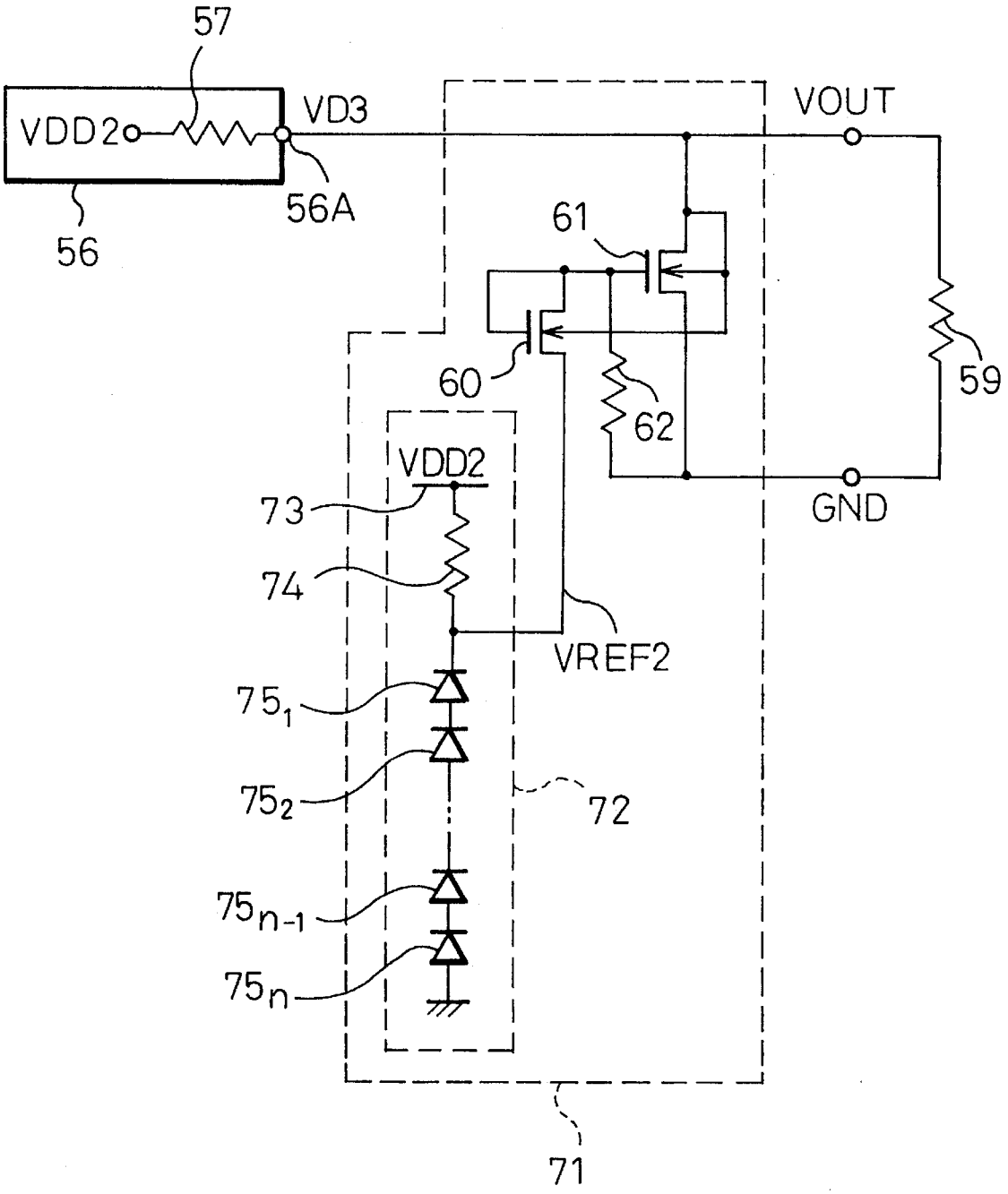
FIG. 19 is a circuit diagram showing the constitution of the constant voltage supplying circuit according to a tenth embodiment of the present invention.

Tenth embodiment . . . FIG. 19

FIG. 19 shows the circuit constitution of the tenth embodiment of the present invention.

In the drawing, reference numeral 71 denotes a constant voltage supplying circuit according to the tenth embodiment. This constant voltage supplying circuit 71 includes a built-in reference voltage generation circuit 72 for generating a reference voltage VREF2. The rest of the circuit constitution are the same as those of the constant voltage supplying circuit 58 of the seventh embodiment shown in FIG. 16, and the explanation will be omitted.

In the reference voltage generation circuit 72, reference numeral 73 denotes a power supply line for supplying a voltage VDD2; 74 denotes a resistor; and $75_1$ to $75_n$ denote diodes. This reference voltage generation circuit 72 shifts the level of the voltage VDD2 and obtains the reference voltage VREF2.

As described above, the constant voltage supplying circuit 71 of the tenth embodiment stabilizes the voltage VD3 at the voltage output terminal 56A of the voltage generation circuit 56 to the same voltage value as the reference voltage VREF2 irrespective of variance of the characteristics of the n-MOS transistors 60, 61 in the same way as the constant voltage supplying circuit 58 of the seventh embodiment shown in FIG. 16, and can supply it as the output voltage VOUT to the load.

Since the resistor 62 having a high resistance is interposed between the drain of the n-MOS transistor 60 and the ground, the drain voltage of the n-MOS transistor 60 is stabilized to VREF2+VTHn, and even when a noise is superposed with the reference voltage VREF2, for example, a reverse bias is established between the drain of the n-MOS transistor 60 and the p-well at which this transistor 60 is formed, so that the drain voltage of the n-MOS transistor 60 is prevented from becoming unstable.

Further, the constant voltage supplying circuit 71 of this tenth embodiment can be constituted by the n-MOS transistors 60, 61, the resistor 74 and the diodes $75_1$ to $75_n$. Therefore, even when it is fabricated in the integrated circuit, it does not invite the increase of the production steps and does not either increase the cost of production.

Figure 20:
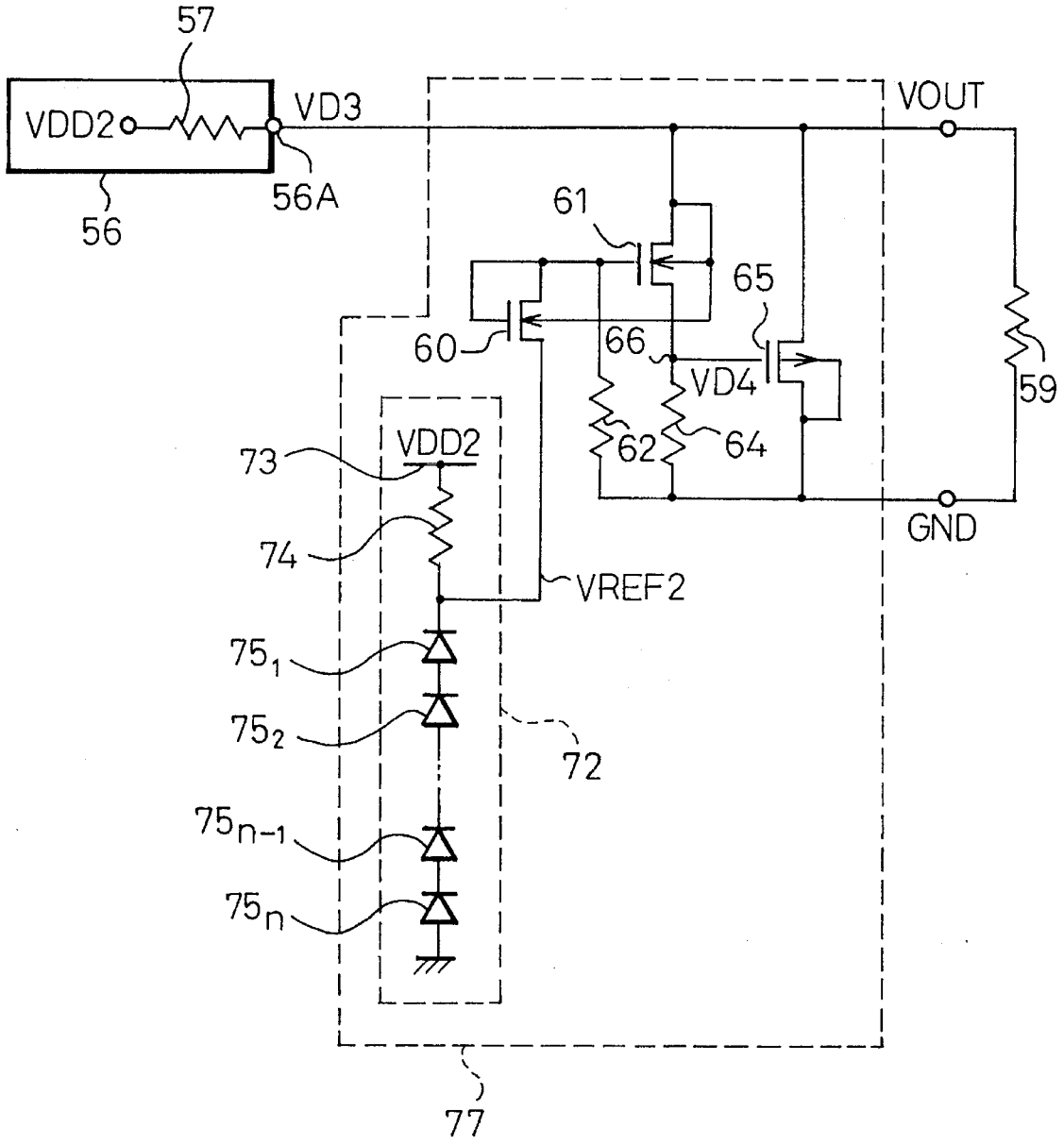
FIG. 20 is a circuit diagram showing the constitution of the constant voltage supplying circuit according to an eleventh embodiment of the present invention.

Eleventh embodiment . . . FIG. 20

FIG. 20 shows the circuit constitution of the eleventh embodiment of the present invention.

In the drawing, reference numeral 77 denotes the constant voltage supplying circuit according to the eleventh embodiment. This constant voltage supplying circuit 77 includes a built-in reference voltage generation circuit 72 in the same way as the constant voltage supplying circuit 71 shown in FIG. 19. Since the rest of the circuit constitution are the same as those of the constant voltage supplying circuit 63 of the eighth embodiment shown in FIG. 17, the explanation will be omitted.

As described above, the constant voltage supplying circuit 77 according to the eleventh embodiment stabilizes the voltage VD3 at the voltage output terminal 56A of the voltage generation circuit 56 to the same voltage value as the reference voltage VREF2 irrespective of variance of the characteristics of the n-MOS transistors 60, 61 and the p-MOS transistor 65, in the same way as in the constant voltage supplying circuit 63 of the eighth embodiment shown in FIG. 17 and can supply it as the output voltage VOUT to the load.

Since the resistor 62 having a high resistance is interposed between the drain of the n-MOS transistor 60 and the ground, the drain voltage of the n-MOS transistor 60 is stabilized to VREF2+VTHn, and even when a noise is superposed with the reference voltage VREF2, for example, a reverse bias is established between the drain of the n-MOS transistor 60 and the p-well at which this transistor 60 is formed, so that the drain voltage of the n-MOS transistor 60 is prevented from becoming unstable.

Since the constant voltage supplying circuit 77 of this eleventh embodiment is equipped with the resistor 64 and the p-MOS transistor 65 in the same way as the constant voltage supplying circuit 63 of the eighth embodiment shown in FIG. 17, stabilization of the voltage VD3 at the voltage output terminal 56A of the voltage generation circuit 56 can be made within a shorter time than the constant voltage supplying circuit 71 of the tenth embodiment shown in FIG. 19.

Further, the constant voltage supplying circuit 77 of this eleventh embodiment can be constituted by the n-MOS transistors 60, 61, the resistors 64, 74, the p-MOS transistor 65 and the diodes $75_1$ to $75_n$. Therefore, even when this constant voltage supplying circuit 77 is fabricated in the integrated circuit, it does not invite the increase of the production steps and does not either increase the cost of production.

Figure 21:
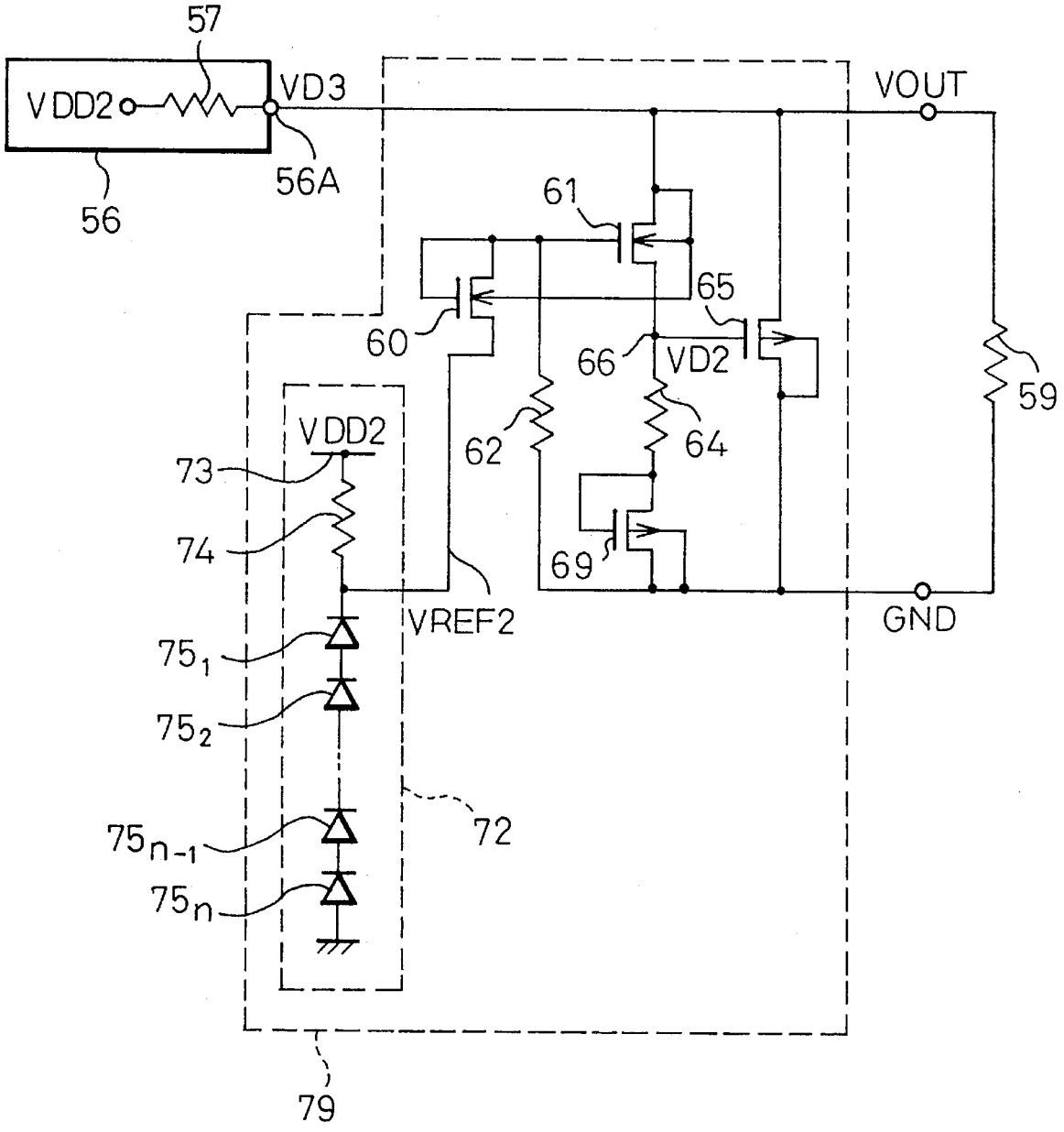
FIG. 21 is a circuit diagram showing the constitution of the constant voltage supplying circuit according to a twelfth embodiment of the present invention.

Twelfth embodiment . . . FIG. 21

FIG. 21 shows the circuit constitution of the twelfth embodiment of the present invention.

In the drawing, reference numeral 79 denotes the constant voltage supplying circuit according to the twelfth embodiment. This constant voltage supplying circuit 79 includes a built-in reference voltage generation circuit 72 in the same way as the constant voltage supplying circuit 71 of the tenth embodiment shown in FIG. 19. Since the rest of the circuit constitution are the same as those of the constant voltage supplying circuit 68 of the ninth embodiment shown in FIG. 18, the explanation will be omitted.

As described above, the constant voltage supplying circuit 79 according to the twelfth embodiment stabilizes the voltage VD3 at the voltage output terminal 56A of the voltage generation circuit 56 to the same voltage value as the reference voltage VREF2 irrespective of variance of the characteristics of the n-MOS transistors 60, 61 and the p-MOS transistors 65, 69, in the same way as the constant voltage supplying circuit 68 of the ninth embodiment shown in FIG. 18, and can supply it as the output voltage VOUT to the load.

Since the resistor 62 having a high resistance is interposed between the drain of the n-MOS transistor 60 and the ground, the drain voltage of the n-MOS transistor 60 is stabilized to VREF2+VTHn, and even when a noise is superposed with the reference voltage VREF2, for example, a reverse bias is established between the drain of the n-MOS transistor 60 and the p-well at which this transistor 60 is formed, so that the drain voltage of the n-MOS transistor 60 is prevented from becoming unstable.

Further, the constant voltage supplying circuit 79 of this twelfth embodiment includes the p-MOS transistor 69 in the same way as the constant voltage supplying circuit 68 of the ninth embodiment shown in FIG. 18. Therefore, stabilization of the voltage VD3 at the voltage output terminal 56A of the voltage generation circuit 56 can be made within a shorter time than the constant voltage supplying circuit of the eleventh embodiment shown in FIG. 20.

Further, since the constant voltage supplying circuit 79 of the twelfth embodiment can be constituted by the n-MOS transistors 60, 61, the resistors 64, 74, the p-MOS transistors 65, 69 and the diodes $75_1$ to $75_n$, it does not invite the increase of the production steps when it is fabricated in the integrated circuit, and does not either increase the cost of production.

Figure 22:
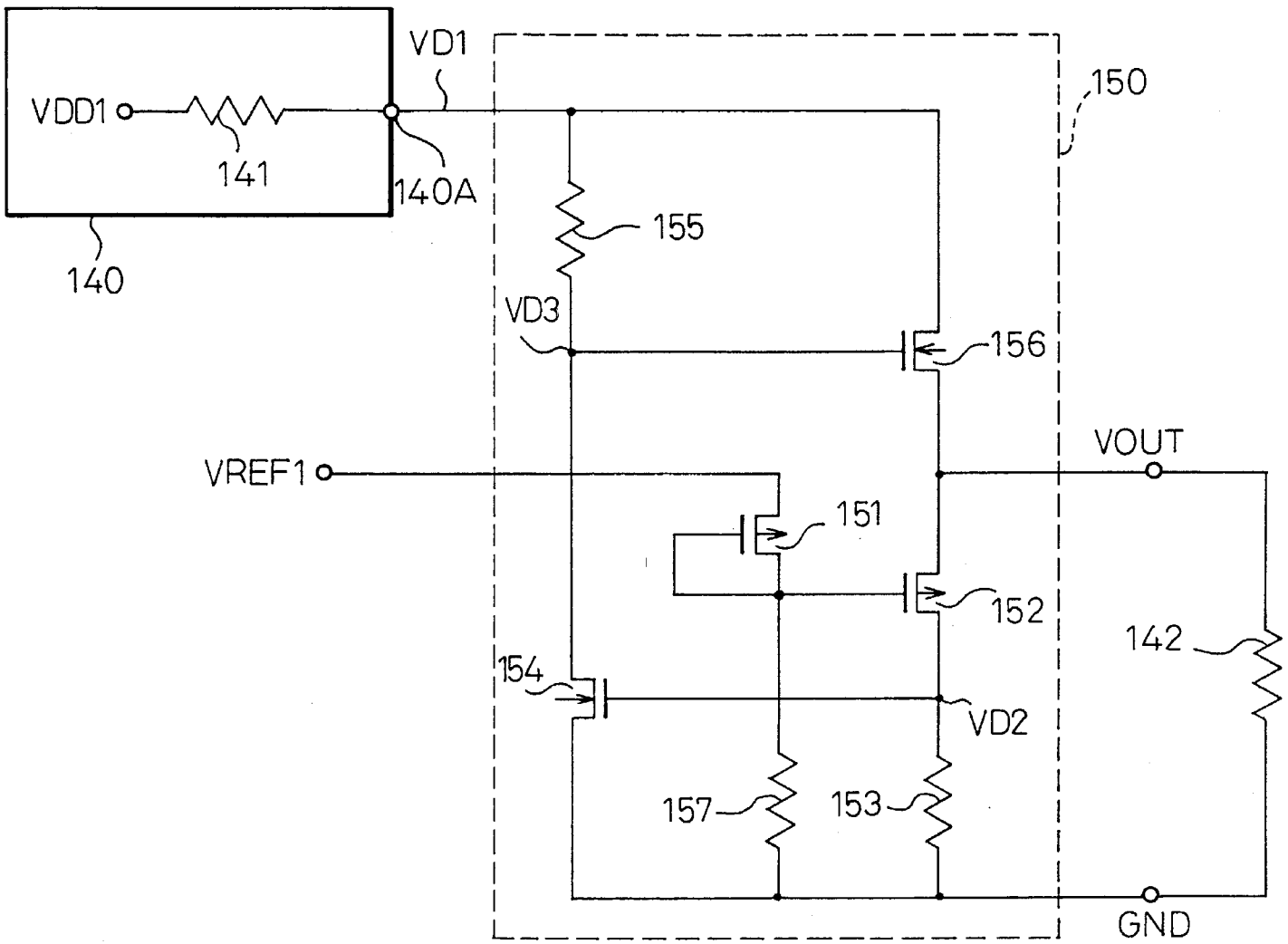
FIG. 22 is a circuit diagram showing the constitution of the constant voltage supplying circuit according to a thirteenth embodiment of the present invention.

Thirteenth embodiment . . . FIG. 22

FIG. 22 shows the circuit constitution of the thirteenth embodiment of the present invention.

In the drawing, reference numeral 150 denotes the constant voltage supplying circuit according to this embodiment, and is disposed between one of the ends of a resistor 142 (the other end is grounded) as the load and a voltage output terminal 140A of the voltage generation circuit 140. The voltage generation circuit 140 generates a positive voltage VDD1 at the time of non-load, and outputs a positive voltage VD1 to the voltage output terminal 140A through an internal resistance 141 when the load is connected.

The constant voltage supplying circuit 150 according to this embodiment comprises a p-MOS transistor 151 the gate of which is connected to its drain, and which receives the positive reference voltage VREF1 at the source thereof, a p-MOS transistor 152 the gate of which is connected to the drain of the p-MOS transistor 151 and the source of which is connected to the output terminal of the constant voltage supplying circuit 150, a resistor 153 connected between the drain of this p-MOS transistor 152 and the ground, an n-MOS transistor 154 the gate of which is connected to the drain of the p-MOS transistor 152 (drain voltage $VD_2$) and the source of which is connected to the ground GND, a resistor 155 connected between the drain of this n-MOS transistor 154 and the voltage output terminal 140A of the voltage generation circuit 140, and an n-MOS transistor 156 which is connected between the voltage output terminal 140A of the voltage generation circuit 140 and the output terminal of the constant voltage supplying circuit 150, and responds to the drain potential VD3 of the n-MOS transistor 154.

A resistor 157 having a high resistance is interposed between the drain of the p-MOS transistor 151 and the ground GND so as to stabilize the gate potential of the p-MOS transistor 152. By the way, the p-MOS transistor 151 is not directed to drive the load 142 but is directed to drive merely the p-MOS transistor 152. Therefore, its transistor size may be small.

The constant voltage supplying circuit 150 of this embodiment contemplates to control the positive output voltage VD1 generated by the voltage generation circuit 140 (which contains also ripple) to the same voltage value as the reference voltage VREF1 (VREF1<VD1), and to thereby stabilize the output voltage VOUT to the reference voltage VREF1.

Hereinafter, the operation of the constant voltage supplying circuit 150 according to this embodiment will be explained in detail.

First, the reference voltage VREF1 (>0) is applied to the source of the p-MOS transistor 151. Since the gate and the drain of this p-MOS transistor are short-circuited, $VDS_{51}=VGS_{51}=|VTHp|$when the drain-source voltage of this p-MOS transistor is $VDS_{51}$ its gate-source voltage is $VGS_{51}$ and the threshold voltage is VTHp (<0). As a result, the gate potential $VG_{52}$ of the p-MOS transistor 152 is given by $VG_{52}=VREF1-|VTHp|$, and the gate-source voltage $VGS_{52}$ of the p-MOS transistor 152 is given by $VGS_{52}=VG_{52}-VOUT=(VREF1-|VTHp|)-VOUT=(VREF1-VOUT)-|VTHp|$.

Accordingly, as long as the relation VOUT>VREF1 is satisfied, $VGS_{52}<-|VTHp|$. Therefore, the p-MOS transistor 152 is turned ON, and as long as VOUT<VREF1, on the contrary, the p-MOS transistor 152 is turned OFF.

Here, the voltage VD1 containing the ripple is biased to the gate and the drain of the n-MOS transistor 156 by the voltage generation circuit 140. Since VOUT=0 at the beginning, $VGS_{56}>VTHn$ where $VGS_{56}$ is the gate-source voltage of the n-MOS transistor 156 and VTHn (>0) is the threshold voltage. Therefore, the n-MOS transistor 156 is turned ON, and a current path of VD1→n-MOS transistor 156→VOUT→load 142→GND is formed, so that the output voltage VOUT rises from 0.

(1) When output voltage VOUT>VREF1:

In this case, the p-MOS transistor 152 is turned ON, and a current path of VD1→n-MOS transistor 156→VOUT→p-MOS transistor 152→VD2→ resistor 153→GND besides the current path passing through the load 142. Accordingly, the drain potential VD2 of the p-MOS transistor 152 exhibits a certain potential.

Assuming that the gate-source voltage of the n-MOS transistor is $VGS_{54}$, the n-MOS transistor 154 is turned ON when the relation VD2>VTHn is satisfied because $VGS_{54}=VD2$. Therefore, a current path VD1 resistor 155–VD3→n-MOS transistor 154→GND is formed. As a result, the drain potential VD3 of the n-MOS transistor 154 drops by a voltage corresponding to the voltage drop due to the resistor 155 from the output voltage VD1 of the voltage generation circuit 140. As the current further increases, the gate-source voltage $VGS_{56}$ of the n-MOS transistor 156 satisfies the relation $VGS_{56}=VD3-VOUT<VTHn$, and the n-MOS transistor 156 is turned OFF.

Accordingly, the supply of the current from the voltage generation circuit 140 (output voltage VD1) to the load 142 is stopped, and the output voltage VOUT starts lowering, and finally reaches equilibrium at the point when VOUT=VREF1 is satisfied.

In this case, if the sum of the resistance value of the resistor 155 and the ON resistance of the n-MOS transistor 154 and the sum of the p-MOS transistor 152 and the resistance value of the resistor 153 are so set in advance as to be sufficiently greater than the resistance value of the load 142, a substantial current path is only the path passing through the load 142. Therefore, the voltage VD1 supplied from the voltage generation circuit 140 can be consumed only by the load 142 without any waste.

(2) When output voltage VOUT<VREF1:

In this case, the p-MOS transistor 152 is turned OFF, the relation $VD2=VGS_{54}=0$ is satisfied and the n-MOS transistor 154 is turned OFF. As a result, the gate potential VD3 of the n-MOS transistor 156 is raised to the same level as the output voltage VD1 of the voltage generation circuit 140, and the n-MOS transistor 156 is turned ON.

Accordingly, the current is supplied from the voltage generation circuit 140 (output voltage VD1) to the load 142 through the n-MOS transistor 156, and the output voltage VOUT starts rising, and finally reaches equilibrium at the point when VOUT=VREF1 is satisfied.

As described above, the constant voltage supplying circuit 150 according to this embodiment so functions as to take the state (1) where the transistors 152 and 154 are ON but the transistor 156 is OFF, or the state (2) where the transistors 152 and 154 are OFF but the transistor 156 is ON, in accordance with the condition where the output voltage VOUT is greater than the reference voltage VREF1 or the condition where the former is smaller than the latter. In other words, since the circuit 150 has the closed loop structure, it can stabilize the output voltage VOUT to the same voltage value as the desired reference voltage VREF1 by suitably repeating the operations of the items (1) and (2) described above. For this reason, the constant voltage supplying circuit 150 of this embodiment is extremely effective for a load which undergoes fluctuation, such as a CCD.

As described above, the constant voltage supplying circuit 156 according to this embodiment stabilizes the output voltage VD1 of the voltage generation circuit 140 to the same voltage value as the reference voltage VREF1 irrespective of variance of the characteristics of the MOS transistors 151, 152, 154 and 156 used, and can supply it as the output voltage VOUT to the load 142.

Since the constant voltage supplying circuit 150 can be constituted by the MOS transistors 151, 152, 154 and 156 and the resistors 153, 155, 156 and 157, it does not invite the increase of the production process even when it is fabricated in the integrated circuit, and does not either increase the cost of production.

Further, wasteful consumption of power at portions other than the load 142 can be substantially eliminated by selecting the resistance values of the resistors 153, 155 and the ON resistance of the MOS transistors 152, 154 to the specific values as described above.

Figure 23:
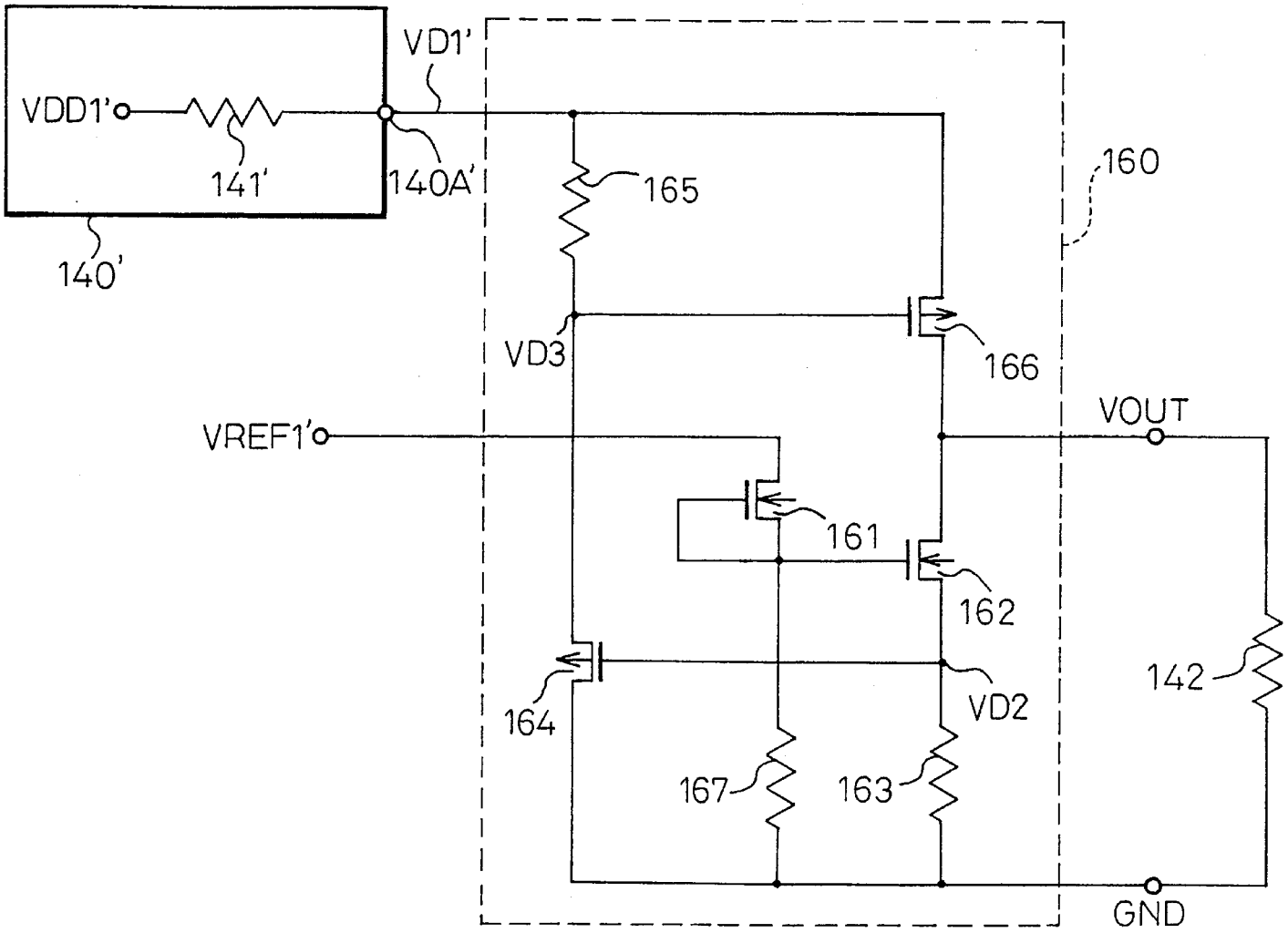
FIG. 23 is a circuit diagram showing the constitution of the constant voltage supplying circuit according to a fourteenth embodiment of the present invention.

Fourteenth embodiment . . . FIG. 23

FIG. 23 shows the circuit constitution of the fourteenth embodiment of the present invention.

In comparison with the constant voltage supplying circuit 150 of the first embodiment (see FIG. 22), the constant voltage supplying circuit 160 is different in that the conductivity type of each of the MOS transistors 162, 164 and 166 used is opposite to the conductivity type of each of the MOS transistors 152, 154 and 156 of the first embodiment. Since the rest of the circuit constitution are the same as those of the thirteenth embodiment, the explanation will be omitted.

Whereas the thirteenth embodiment is directed to stabilize the output voltage VOUT to the positive reference voltage VREF1, this embodiment is directed to stabilize the output voltage VOUT to a desired negative reference voltage VREF1'.

Therefore, the constant voltage supplying circuit 160 of this embodiment is disposed between the voltage output terminal 140A' of the voltage generation circuit 140' and one of the ends of the resistor 142 as the load (the other end of which is grounded). In this case, the voltage generation circuit 140' generates a negative voltage VDD1' at the time of non-load, and outputs the negative output voltage VD1' to the voltage output terminal 140A' through the internal resistance 141' when the load is connected.

The function and effect of the constant voltage supplying circuit 160 of this fourteenth embodiment can be easily inferred from the function and effect of the constant voltage supplying circuit 150 of the thirteenth embodiment. Therefore, the explanation will be omitted.

Figure 24:
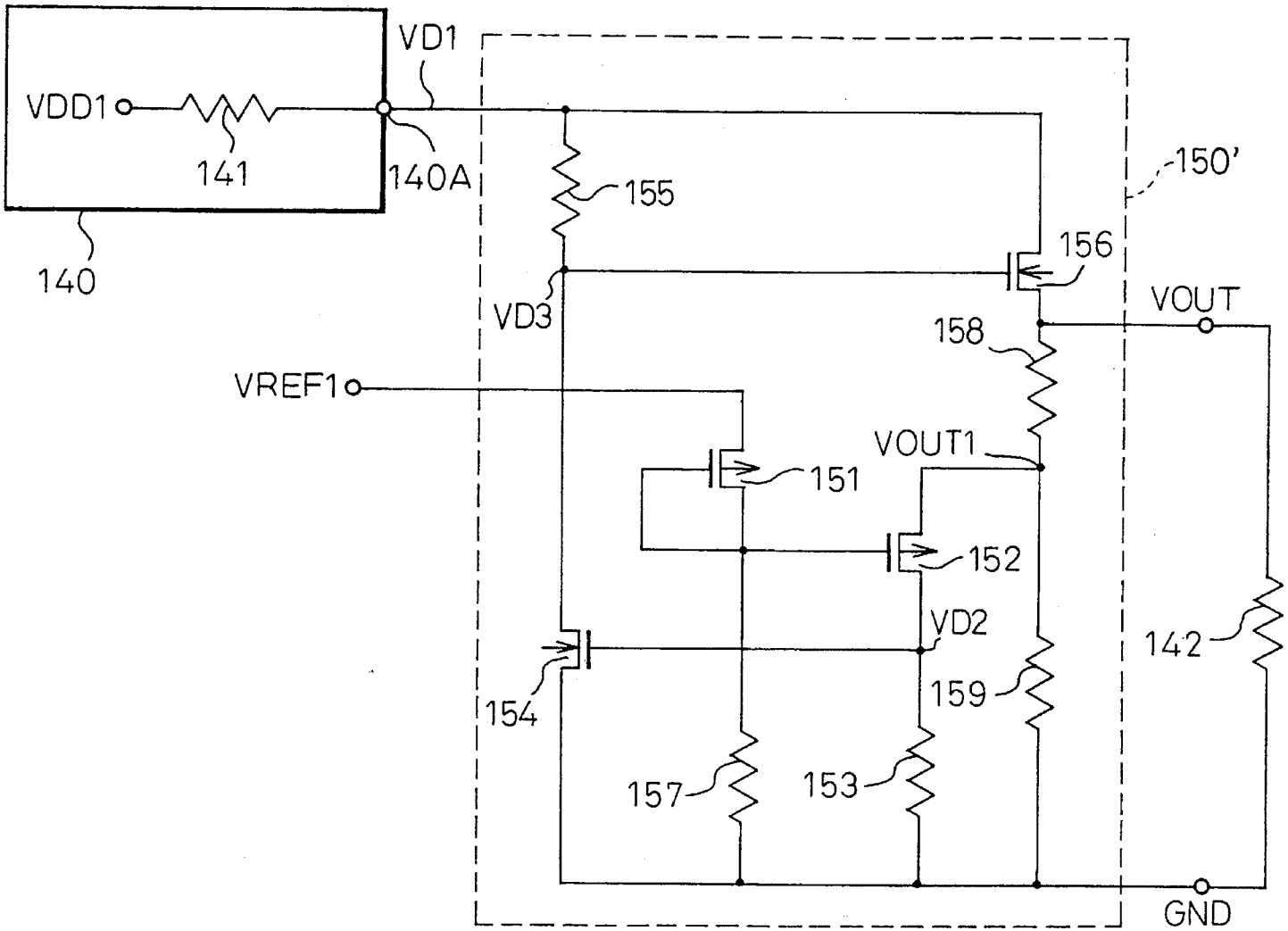
FIG. 24 is a circuit diagram showing the constitution of the constant voltage supplying circuit according to a fifteenth embodiment of the present invention.

Fifteenth embodiment . . . FIG. 24

FIG. 24 shows the circuit constitution of the fifteenth embodiment of the present invention.

In comparison with the constant voltage supplying circuit 150 of the thirteenth embodiment (shown in FIG. 22), the constant voltage supplying circuit 150' of this embodiment is different in that resistors 158 and 159 (having resistance values of RA and RB, respectively) are connected in series between the source of the n-MOS transistor 156 and the ground GND in place of the direct connection of the source of the p-MOS transistor 152 to that of the n-MOS transistor 156, and the junction (the potential of which is VOUT1) of these resistors is connected to the source of the p-MOS transistor 152. In this case, the original output voltage VOUT is taken out from the source of the n-MOS transistor 156. The rest of the circuit constitution are the same as those of the thirteenth embodiment, and the explanation will be omitted.

In order to stabilize the output voltage VOUT to the reference voltage VREF1 in the constitution of the thirteenth embodiment (see FIG. 22), the p-MOS transistor 152 so functions as to be turned ON when VOUT>VREF1 and to be turned OFF when VOUT<VREF1. In other words, the circuit is so constituted as to effect the switching operation depending on the difference between the source potential of the p-MOS transistor 152 and the reference voltage VREF1. In this case, therefore, the reference voltage for switching is a fixed value in accordance with the value of VREF1.

In contrast, in the constitution of this embodiment (see FIG. 24), the p-MOS transistor 152 so functions as to be turned ON when VOUT1>RB/(RA+RB)×VOUT=RB/(RA+RB)×VREF1, and to be turned OFF when VOUT1<RB/(RA+RB)×VOUT=RB/(RA+RB)×VREF1, in order to stabilize the output voltage VOUT to the reference voltage VREF1. In other words, this circuit so functions as to effect the switching operation in accordance with the difference between the source potential VOUT1 of the p-MOS transistor 152 and the value RB/(RA+RB)×VREF1.

According to the constitution of the constant voltage supplying circuit 150' of this fifteenth embodiment, therefore, the reference voltage for switching can be set to an arbitrary value by suitably selecting each resistance value (RA, RB) of the resistor 158, 159. In other words, this embodiment provides the advantage that freedom for the selection of the reference voltage for switching is high, in addition to the effects obtained by the thirteenth embodiment described already.

Figure 25:
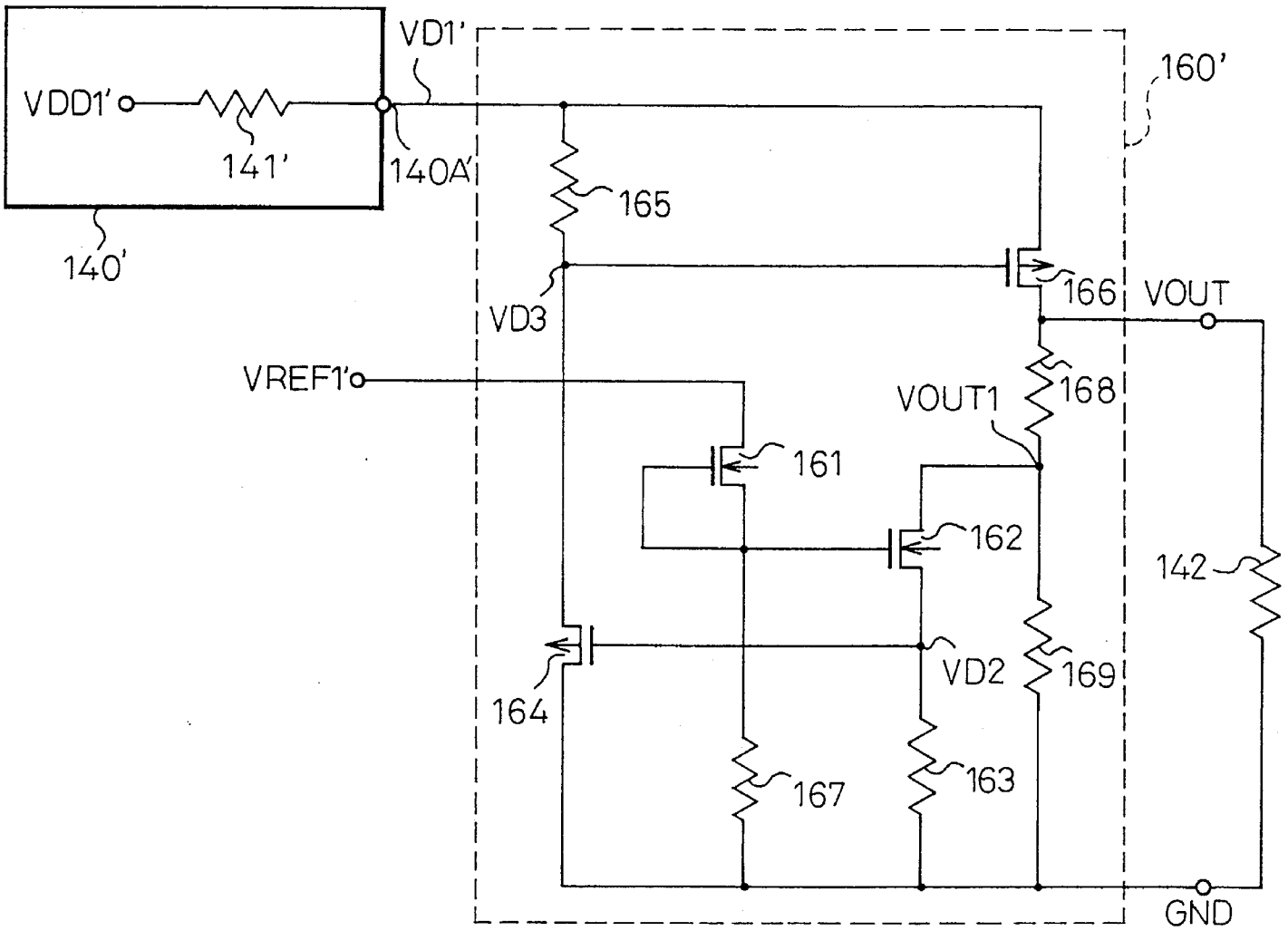
FIG. 25 is a circuit diagram showing the constitution of the constant voltage supplying circuit according to a sixteenth embodiment of the present invention.

Sixteenth embodiment . . . FIG. 25

FIG. 25 shows the circuit constitution of the sixteenth embodiment of the present invention.

In comparison with the constant voltage supplying circuit 160 of the fourteenth embodiment (see FIG. 23), the constant voltage supplying circuit 160' of this embodiment is different in that resistors 168 and 169 are connected in series between the source of the p-MOS transistor 166 and the ground GND in place of the direct connection of the source of the n-MOS transistor 162 to that of the p-MOS transistor 166, and the source of the n-MOS transistor 162 is connected to the junction of these resistors. In this case, the original output voltage VOUT is taken out from the source of the p-MOS transistor 166. Since the rest of the constitution are the same as those of the fourteenth embodiment, the explanation will be omitted.

Since the function and effect of the constant voltage supplying circuit 160' according to this sixteenth embodiment can be easily inferred from the combination of the function and effect of the constant voltage supplying circuit 160 of the fourteenth embodiment with that of the constant voltage supplying circuit 150' of the fifteenth embodiment, the explanation will be omitted.

Figure 26:
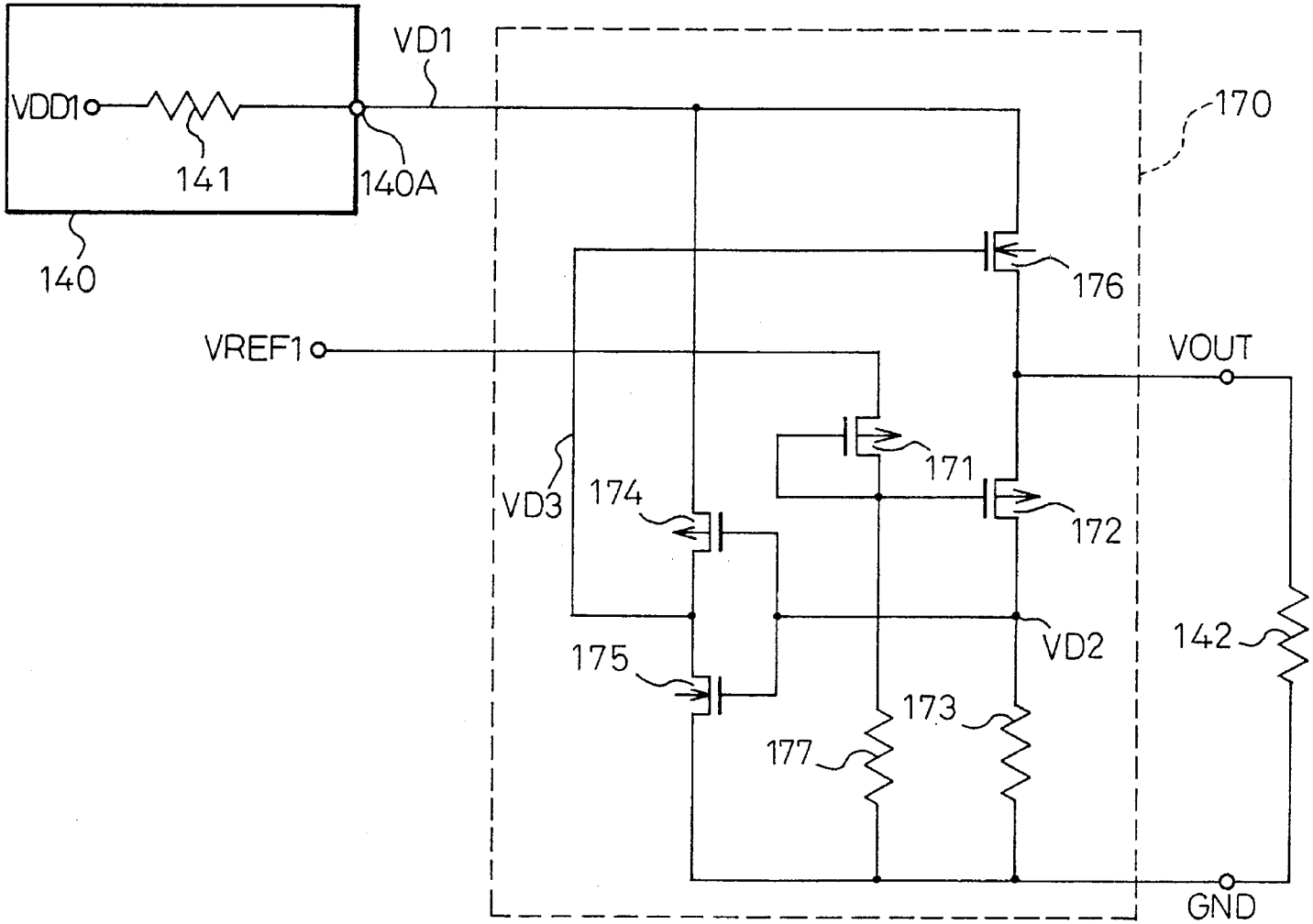
FIG. 26 is a circuit diagram showing the constitution of the constant voltage supplying circuit according to a seventeenth embodiment of the present invention.

Seventeenth embodiment . . . FIG. 26

FIG. 26 shows the circuit constitution of the seventeenth embodiment of the present invention.

The constant voltage supplying circuit 170 of this embodiment is interposed between the voltage output terminal 140A of the voltage generation circuit 140 and one of the ends of the resistor 142 (the other end of which is grounded) as the load, in the same way as the constant voltage supplying circuit 150 of the thirteenth embodiment (see FIG. 22). Similarly, the voltage generation circuit 140 generates the positive voltage at the time of non-load, and outputs the positive output voltage VD1 to the voltage output terminal 140A through the internal resistance 141 when the load is connected.

The constant voltage supplying circuit 170 according to this embodiment includes a p-MOS transistor 171 the gate of which is connected to its drain and which receives the positive reference voltage VREF1 at the source thereof, a p-MOS transistor 172 the gate of which is connected to the drain of the p-MOS transistor 171 and the source of which is connected to the output terminal of the constant voltage supplying circuit 170, a resistor 173 connected between the drain of this p-MOS transistor 172 and the ground GND, a CMOS inverter (p-MOS transistor 174 and n-MOS transistor 175) connected between the voltage output terminal 140A of the voltage generation circuit 140 and the ground GND and responding to the drain potential VD2 of the p-MOS transistor 172, and an n-MOS transistor 176 connected between the voltage output terminal 140A of the voltage generation circuit 140 and the output terminal of the constant voltage supplying circuit 170, and responding to the output voltage VD3 of the CMOS inverter 174, 175.

A resistor 177 having a high resistance is disposed between the drain of the p-MOS transistor 171 and the ground GND so as to stabilize the gate potential of the p-MOS transistor 172. By the way, since the p-MOS transistor 171 is not directed to drive the load 142 but is directed to drive merely the p-MOS transistor 172, its transistor size may be small.

The constant voltage supplying circuit 170 according to this embodiment controls the positive output voltage VD1 (which is assumed to contain a ripple) generated by the voltage generation circuit 140 so as to let it attain the same voltage value as the reference voltage VREF1 (VREF1<VD1) and thus to stabilize the output voltage VOUT to the reference voltage VREF1, in the same way as the constant voltage supplying circuit 150 according to the thirteenth embodiment (see FIG. 22).

Since the form of the operation of the constant voltage supplying circuit 170 according to this embodiment is the same as that of the constant voltage supplying circuit 150 according to the thirteenth embodiment (see FIG. 22), the explanation will be omitted.

In the circuit constitution shown in FIG. 22, ON/OFF control of the n-MOS transistor 156 is made by using the n-MOS transistor 154 and the resistor 155 but in this embodiment (see FIG. 26), ON/OFF control of the n-MOS transistor 176 is made by using the CMOS inverter 174, 175. Therefore, the ON/OFF operation can be made at a higher speed than in the circuit shown in FIG. 22, and consequently, the output voltage VOUT can follow more quickly the reference voltage VREF1).

Figure 27:
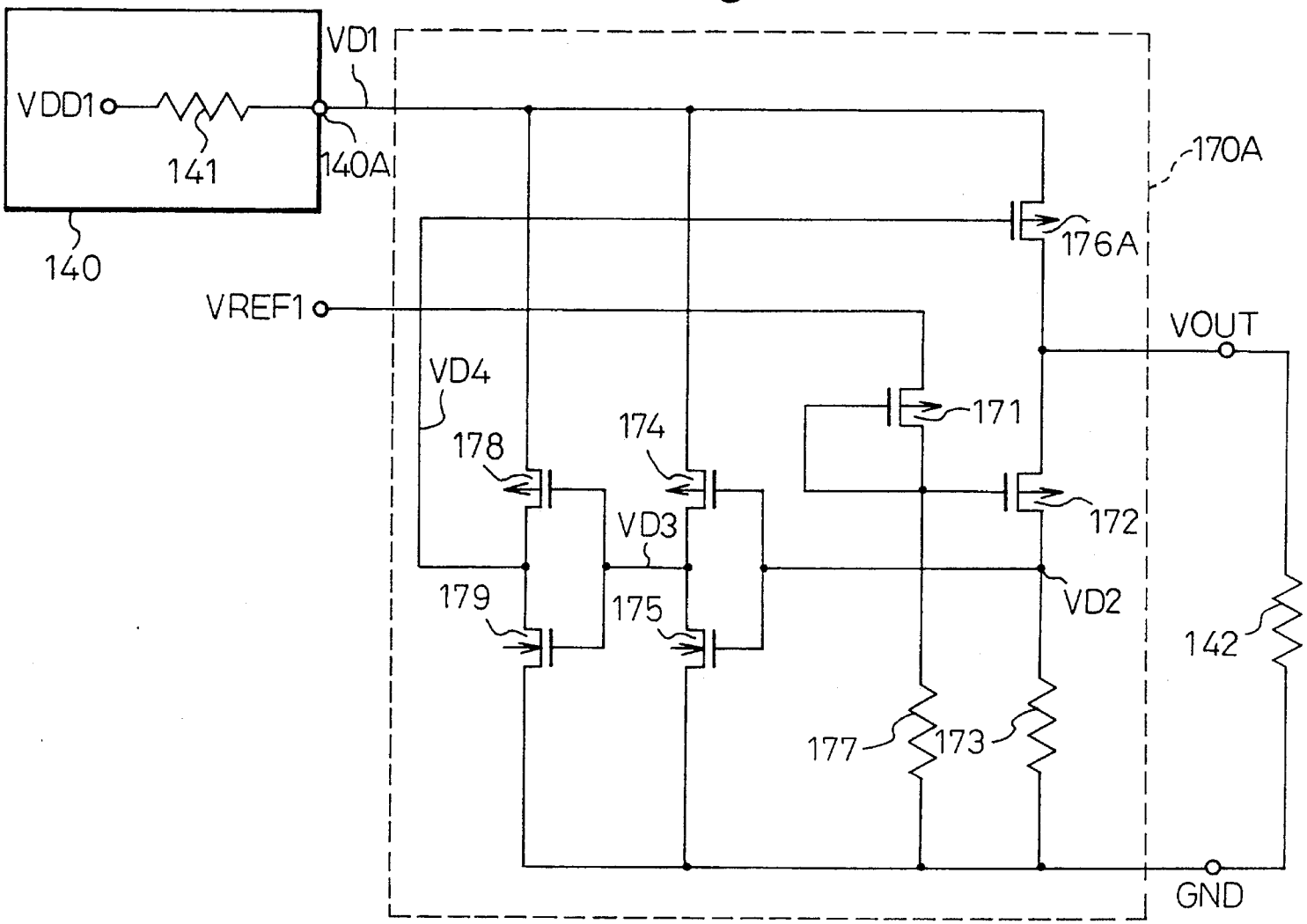
FIG. 27 is a circuit diagram showing the constitution of the constant voltage supplying circuit according to an eighteenth embodiment of the present invention.

Eighteenth embodiment . . . FIG. 27

FIG. 27 shows the circuit constitution of the eighteenth embodiment.

In comparison with the constant voltage supplying circuit 170 according to the seventeenth embodiment (see FIG. 26), the constant voltage supplying circuit 170A according to this embodiment is different in that (1) the p-MOS transistor 176A is disposed in place of the n-MOS transistor 176 and that (2) a CMOS inverter (p-MOS transistor 178 and n-MOS transistor 179) responding to the output voltage VD3 of the CMOS inverter 174, 175 is further disposed between the voltage output terminal 140A of the voltage generation circuit 140 and the ground GND, and ON/OFF control of the p-MOS transistor 176A is made by using the output voltage VD4 of the CMOS inverter 178, 179. Since the rest of the circuit constitution are the same as those of the thirteenth embodiment, the explanation will be omitted.

This embodiment is directed to stabilize the output voltage VOUT to the positive reference voltage VREF1 in the same way as the thirteenth embodiment. Since the form of the operation is the same as that of the seventeenth embodiment (see FIG. 26), the explanation will be omitted.

Figure 28:
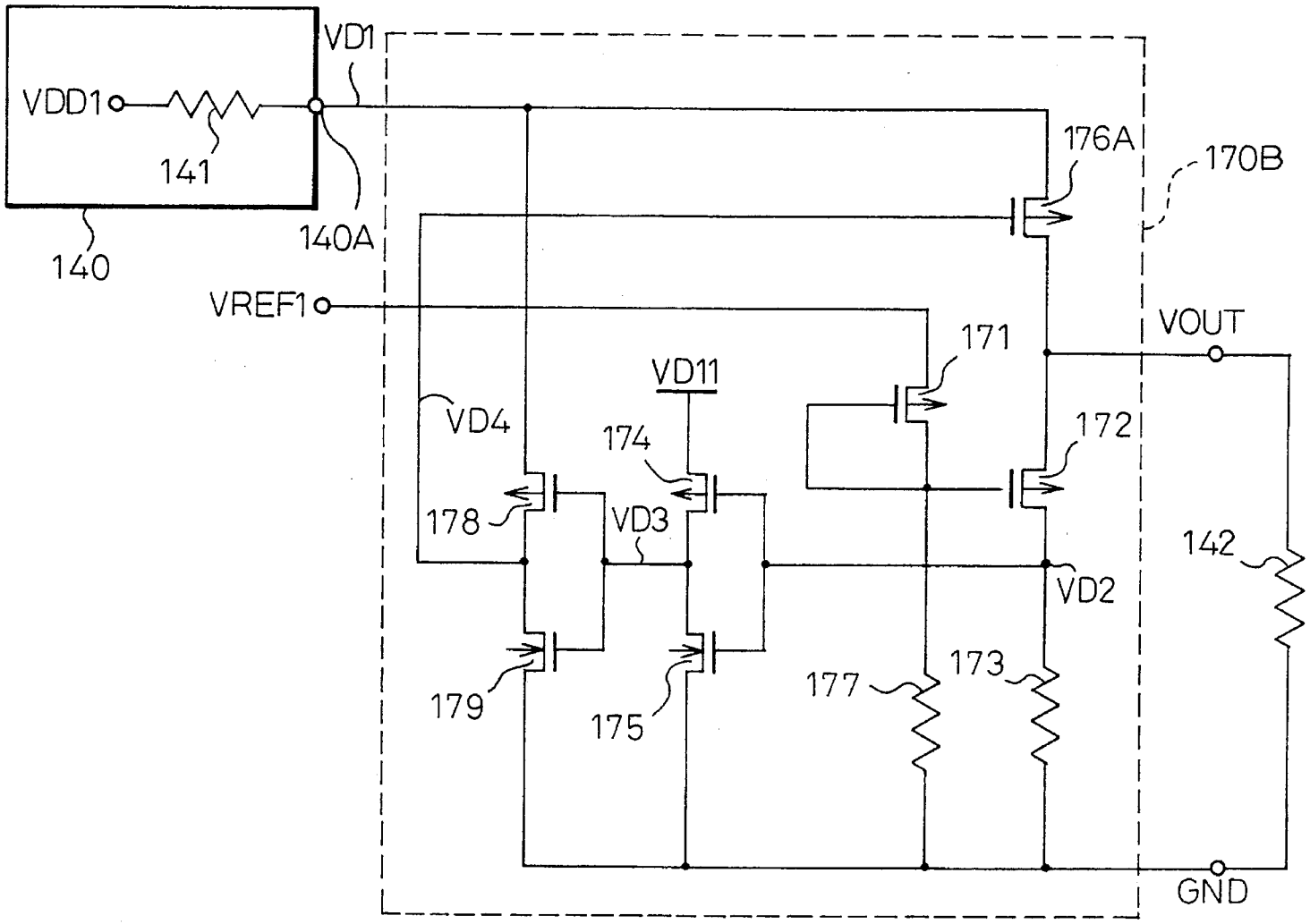
FIG. 28 is a circuit diagram showing the constitution of the constant voltage supplying circuit according to a nineteenth embodiment of the present invention.

Nineteenth embodiment . . . FIG. 28

FIG. 28 shows the circuit constitution of the nineteenth embodiment of the present invention.

In comparison with the constant voltage supplying circuit 170A according to the eighteenth embodiment (see FIG. 27), the constant voltage supplying circuit 170B according to this embodiment is different in that the source of the p-MOS transistor 174 of the CMOS inverter of the first stage is connected to the power supply line of a stable potential VD11 (VD11<VD1) different from the output voltage VD1 (which is assumed to contain a ripple) of the voltage generation circuit 140. Since the rest of the circuit constitution are the same as those of the eighteenth embodiment, the explanation will be omitted.

This embodiment is directed to stabilize the output voltage VOUT to the positive reference voltage VREF1 in the same way as the seventeenth and eighteenth embodiments. Since the form of the operation of the constant voltage supplying circuit 170B according to this embodiment is the same as that of the eighteenth embodiment (see FIG. 27), the explanation will be omitted.

In this embodiment, however, a stable voltage VD11 different from the output voltage VD1 of the voltage generation circuit 140 is applied to the source of the p-MOS transistor 174 of the CMOS inverter of the first stage. Therefore, in comparison with the case of FIG. 27, this embodiment provides the advantage that the CMOS inverter 178, 179 of the next stage can be stably driven without being affected by fluctuation of the output voltage VD1.

Figure 29:
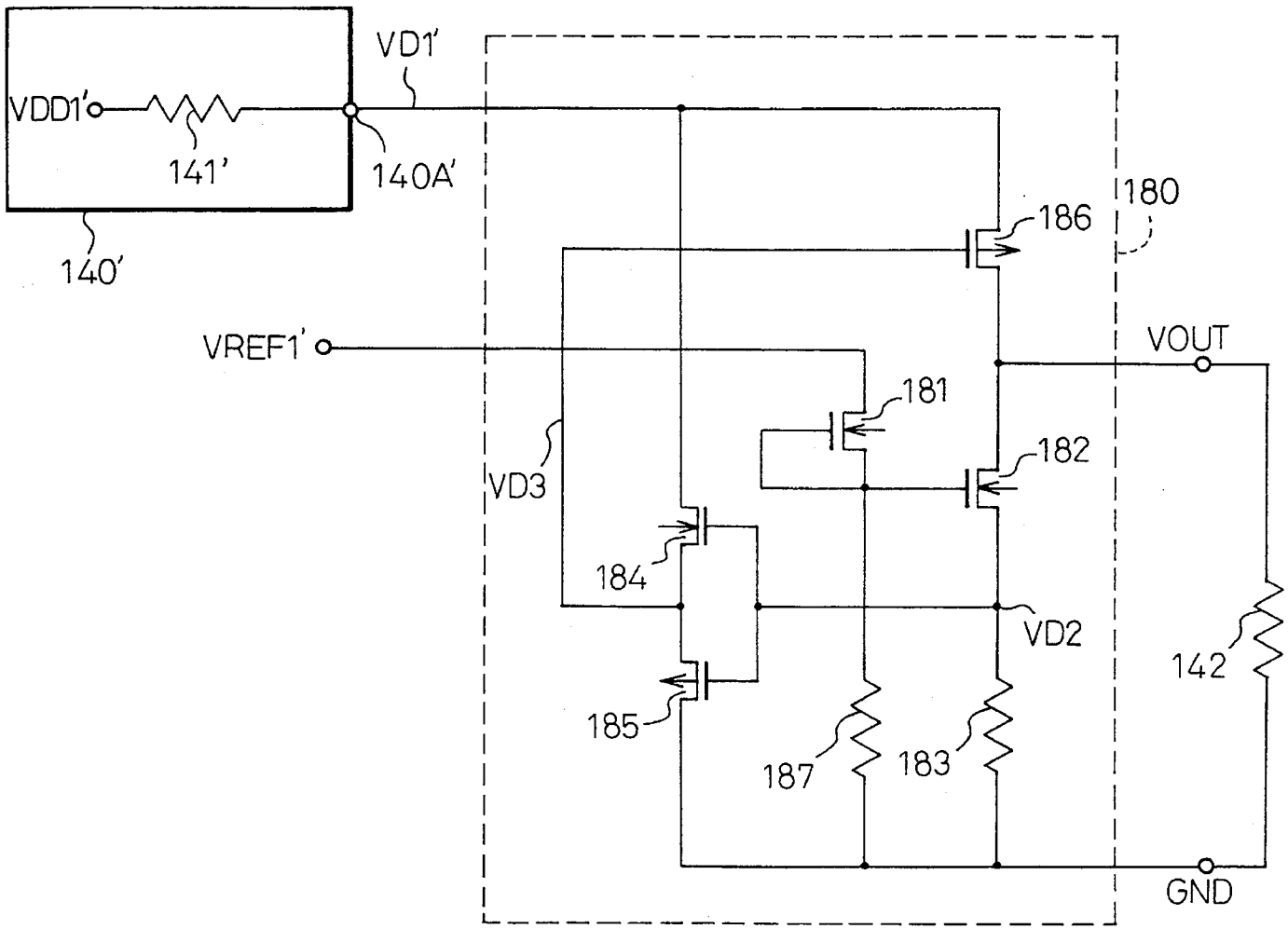
FIG. 29 is a circuit diagram showing the constitution of the constant voltage supplying circuit according to a twentieth embodiment of the present invention.

Twentieth embodiment . . . FIG. 29

FIG. 29 shows the circuit constitution of the twentieth embodiment of the present invention.

In comparison with the constant voltage supplying circuit 170 according to the seventeenth embodiment (see FIG. 26), the constant voltage supplying circuit 180 of this embodiment is different in that the conductivity type of each of the MOS transistors 181, 182, 184, 185 and 186 used is opposite to that of each of the MOS transistors 171, 172, 174, 175 and 176 used in the seventeenth embodiment. Since the rest of the circuit constitution are the same as those of the seventeenth embodiment, the explanation will be omitted.

Whereas the seventeenth embodiment is directed to stabilize the output voltage VOUT to the positive reference voltage VREF1, this embodiment is directed to stabilize the output voltage VOUT to the same voltage value as a desired negative reference voltage VREF1'.

Therefore, the constant voltage supplying circuit 180 of this embodiment is interposed between the voltage output terminal 140A' of the voltage generation circuit 140 and one of the ends of a resistor 142 (the other end of which is grounded) as the load. In this case, the voltage generation circuit 140' generates a negative voltage VDD1' at the time of non-load, and outputs a negative output voltage VD1' to the voltage output terminal 140A' when the load is connected.

Since the function and effect of the constant voltage supplying circuit 180 according to this twentieth embodiment can be easily inferred from that of the constant voltage supplying circuit 170 of the seventeenth embodiment, the explanation will be omitted.

Figure 30:
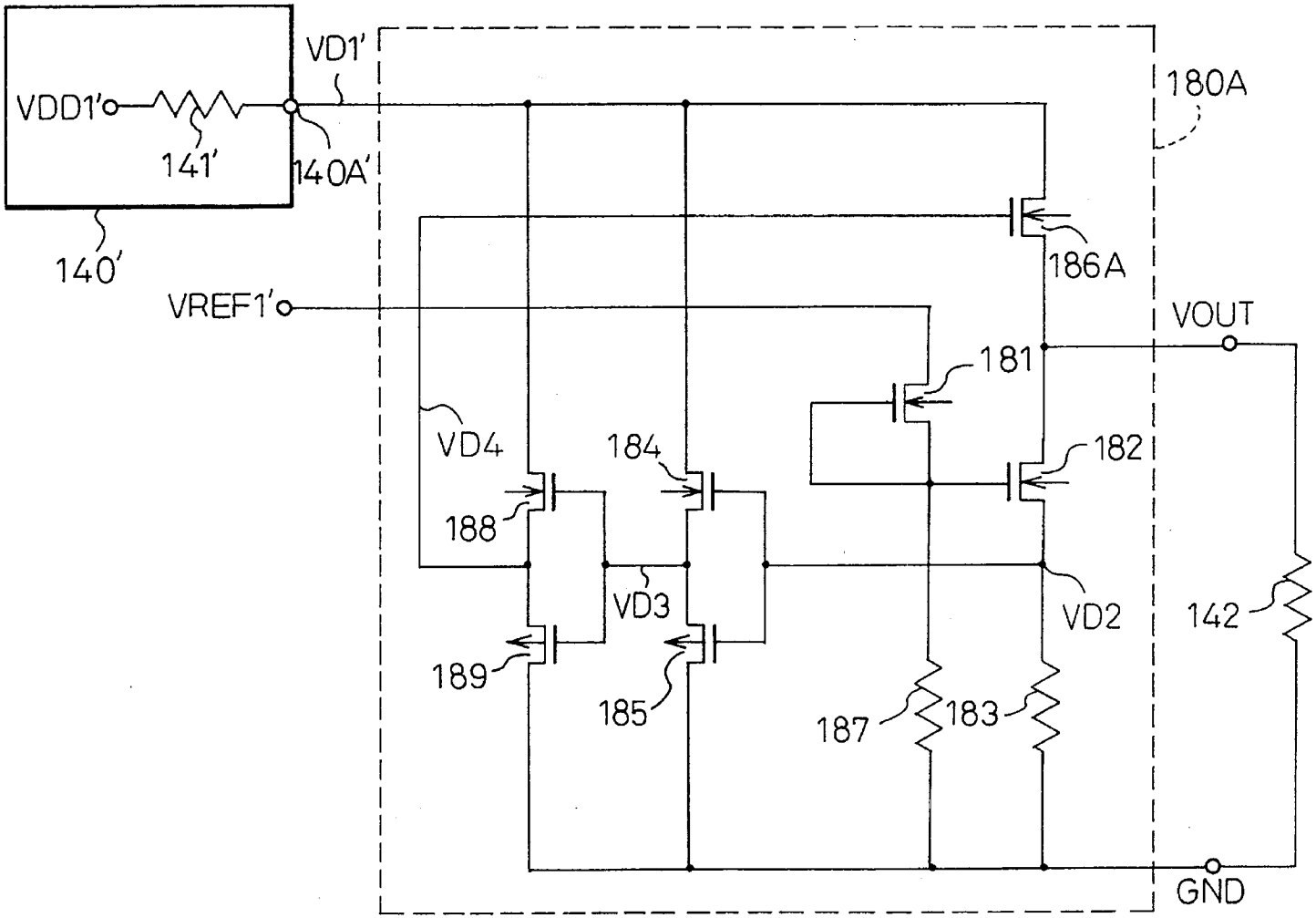
FIG. 30 is a circuit diagram showing the constitution of the constant voltage supplying circuit according to a twenty-first embodiment of the present invention.

Twenty-first embodiment . . . FIG. 30

FIG. 30 shows the circuit constitution of the twenty-first embodiment of the present invention.

In comparison with the constant voltage supplying circuit 180 according to the twentieth embodiment (see FIG. 29), the constant voltage 180A according to this embodiment is different in that (1) an n-MOS transistor 186A is disposed in place of the p-MOS transistor 186, and that (2) a CMOS inverter (n-MOS transistor 188 and p-MOS transistor 189) responding to the output voltage VD3 of the CMOS inverter 184, 185 is further disposed between the voltage output terminal 140A' of the voltage generation circuit 140' and the ground GND and ON/OFF control of the n-MOS transistor 186A is made by the output voltage VD4 of this CMOS inverter 188, 189. Since the rest of the constitution are the same as those of the twentieth embodiment, the explanation will be omitted.

This embodiment is directed to stabilize the output voltage VOUT to the negative reference voltage VREF1' in the same way as the twentieth embodiment. Since the form of the operation is the same as that of the twentieth embodiment (see FIG. 29), the explanation will be omitted.

Figure 31:
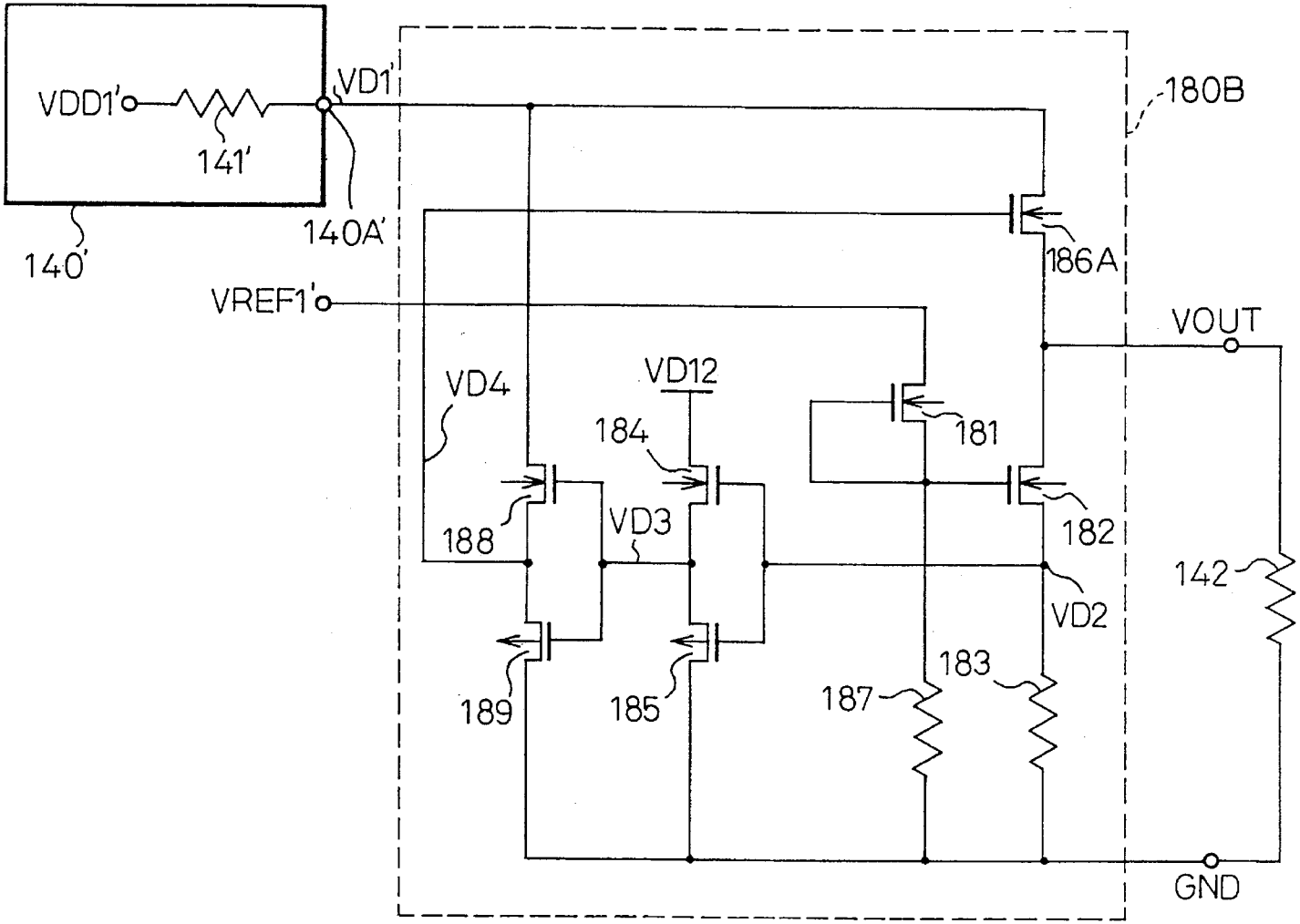
FIG. 31 is a circuit diagram showing the constitution of the constant voltage supplying circuit according to a twenty-second embodiment of the present invention.

Twenty-second embodiment . . . FIG. 31

FIG. 31 shows the circuit constitution of the twenty-second embodiment.

In comparison with the constant voltage supplying circuit 180A according to the twenty-first embodiment (see FIG. 30), the constant voltage supplying circuit 180B according to this embodiment is different in that the source of the n-MOS transistor 184 of the CMOS inverter of the first stage is connected to a stable potential VD12 (VD12>VD1') different from the output voltage VD1' of the voltage generation circuit 140'. Since the rest of the circuit constitution are the same as those of the twenty-first embodiment, the explanation will be omitted.

This embodiment is directed to stabilize the output voltage VOUT to the negative reference voltage VREF1' in the same way as in the twentieth and twenty-first embodiments. Since the form of the operation of the constant voltage supplying circuit 180 of this embodiment is the same as that of the twenty-first embodiment (see FIG. 30), the explanation will be omitted.

However, since a stable voltage VD12 different from the output voltage VD1' of the voltage generation circuit 140' is applied to the source of the n-MOS transistor 184 of the CMOS inverter of the first stage, this embodiment provides the advantage that the CMOS inverter 188, 189 of the next stage can be driven more stably than in the case of FIG. 30 without being affected by fluctuation of the output voltage VD1'.

Figure 32:
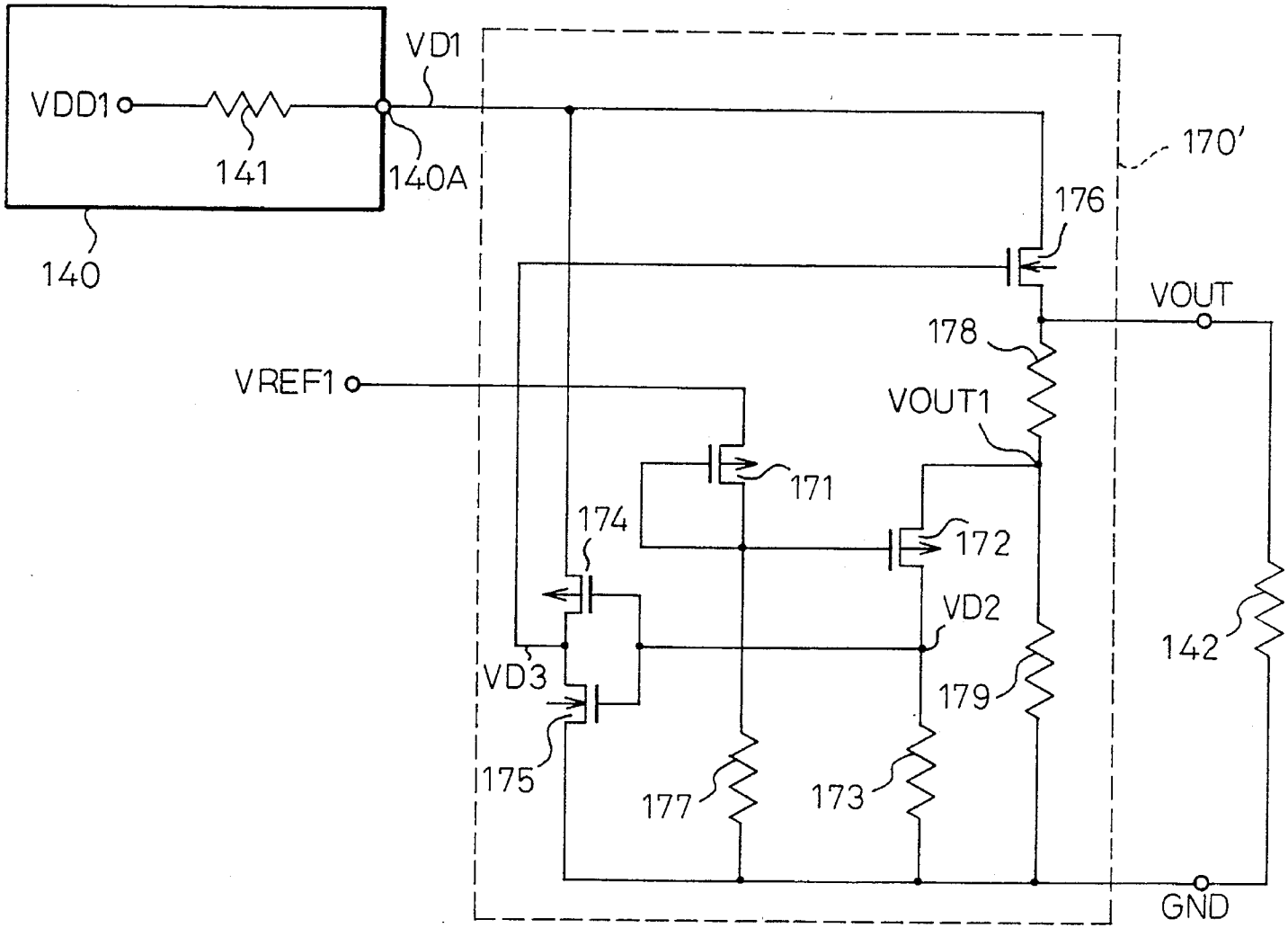
FIG. 32 is a circuit diagram showing the constitution of the constant voltage supplying circuit according to a twenty-third embodiment of the present invention.

Twenty-third embodiment . . . FIG. 32

FIG. 32 shows the circuit constitution of the twenty-third embodiment of the present invention.

In comparison with the constant voltage supplying circuit 170 of the seventeenth embodiment (see FIG. 26), the constant voltage supplying circuit 170' according to this embodiment is different in that the resistors 178 and 179 (having the resistance values RA and RB, respectively) are connected in series between the source of the n-MOS transistor 176 and the ground GND in place of the direct connection of the source of the p-MOS transistor 172 and the source of the n-MOS transistor 176, and the source of the p-MOS transistor 172 is connected to the junction of these resistors. Since the rest of the circuit constitution are the same as those of the seventeenth embodiment, the explanation will be omitted.

In the constitution of the seventeenth embodiment (see FIG. 26), the p-MOS transistor 172 so functions as to be turned ON when VOUT>VREF1 and to be turned OFF when VOUT<VREF1 so as to stabilize the output voltage VOUT to the reference voltage VREF1. In other words, the switching operation is made depending on the difference of the source potential of the p-MOS transistor 172 and VREF1. In this case, therefore, the reference voltage for switching is a fixed value corresponding to the value VREF1.

In contrast, in this embodiment (see FIG. 32), the p-MOS transistor 172 so functions as to be turned ON when VOUT1>RB/(RA+RB)×VOUT=RB/(RA+RB)×VREF1, and to be turned OFF when VOUT1<RB/(RA+RB)×VOUT=RB/(RA+RB)×VREF1, in order to stabilize the output voltage VOUT to the reference voltage VREF1. In other words, the switching operation is made depending on the difference of the source potential VOUT1 of the p-MOS transistor 172 from RB/(RA+RB)×VREF1.

Accordingly, the constant voltage supplying circuit 170' according to this twenty-third embodiment can set the reference voltage for switching to an arbitrary value by suitably selecting the resistance values (RA, RB) of the resistors 178 and 179. In other words, this embodiment provides the advantage that freedom of the selection of the reference voltage for switching is high, in addition to the effects obtained by the seventeenth embodiment.

Figure 33:
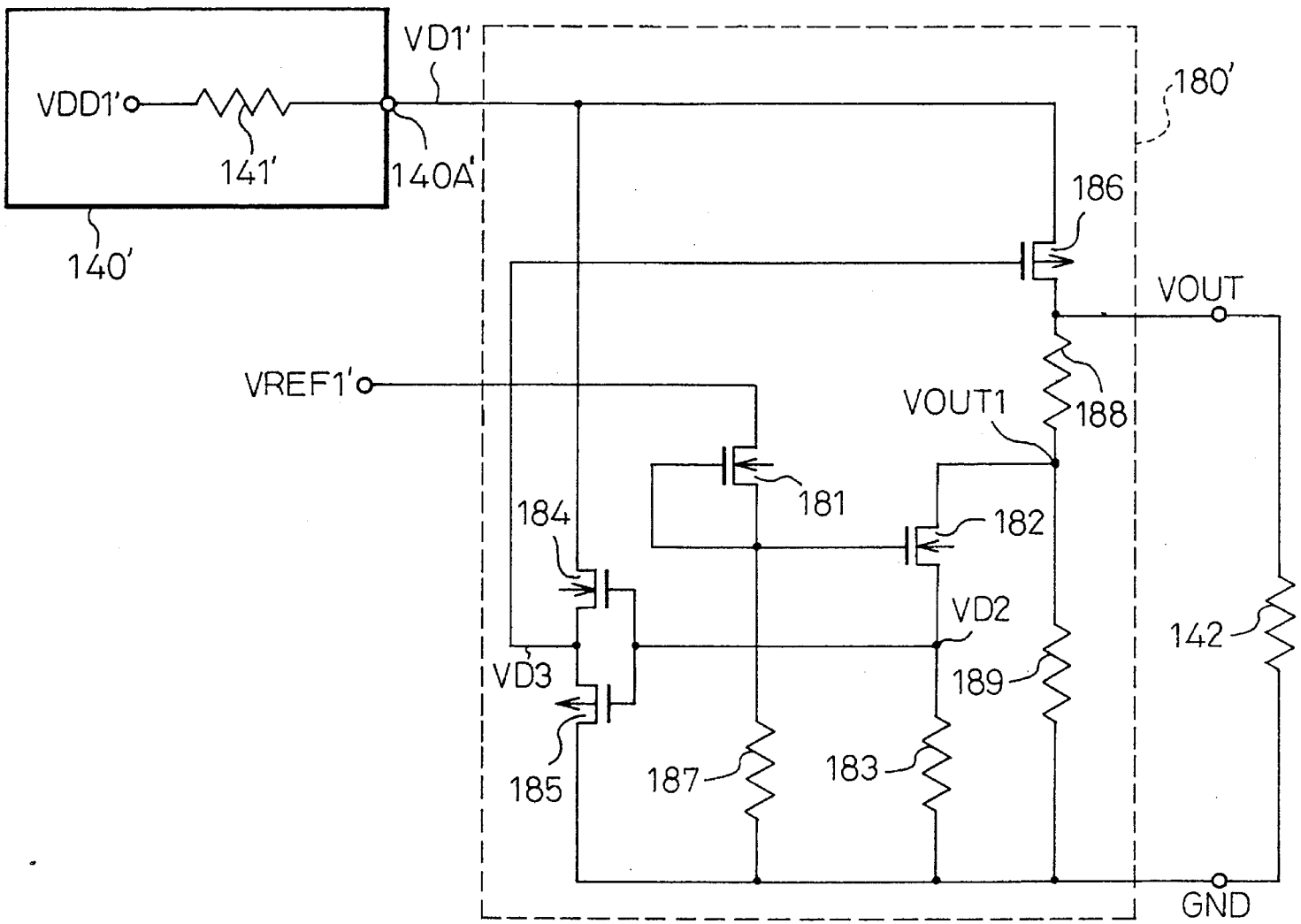
FIG. 33 is a circuit diagram showing the constitution of the constant voltage supplying circuit according to a twenty-fourth embodiment of the present invention.

Twenty-fourth embodiment . . . FIG. 33

FIG. 33 shows the circuit constitution of the constant voltage supplying circuit of the twenty-fourth embodiment of the present invention.

In comparison with the constant voltage supplying circuit 180 according to the twentieth embodiment (see FIG. 29), the constant voltage supplying circuit 180' according to this embodiment is different in that the resistors 188 and 189 are connected in series between the source of the p-MOS transistor 186 and the ground GND in place of the direct connection of the source of the n-MOS transistor 182 and the source of the p-MOS transistor 186, and the source of the n-MOS transistor 182 is connected to the junction of these resistors. In this case, the original output voltage VOUT is taken out from the source of the p-MOS transistor 186. Since the rest of the circuit constitution are the same as those of the twentieth embodiment, the explanation will be omitted.

Since the function and effect of the constant voltage supplying circuit 180' according to the twenty-fourth embodiment can be easily inferred from the combination of the functions and effects of the constant voltage supplying circuits of the twentieth and twenty-third embodiments, the explanation will be omitted.

In each of the foregoing embodiments, the positive or negative reference voltage VREF1 or VREF1' is supplied from outside the corresponding the constant voltage supplying circuit, but the form of supplying the reference voltage VREF1 or VREF1' is not particularly limited thereto. For example, a circuit for generating the reference voltage VREF1 or VREF1' may of course be disposed inside each constant voltage supplying circuit.

Figure 34:
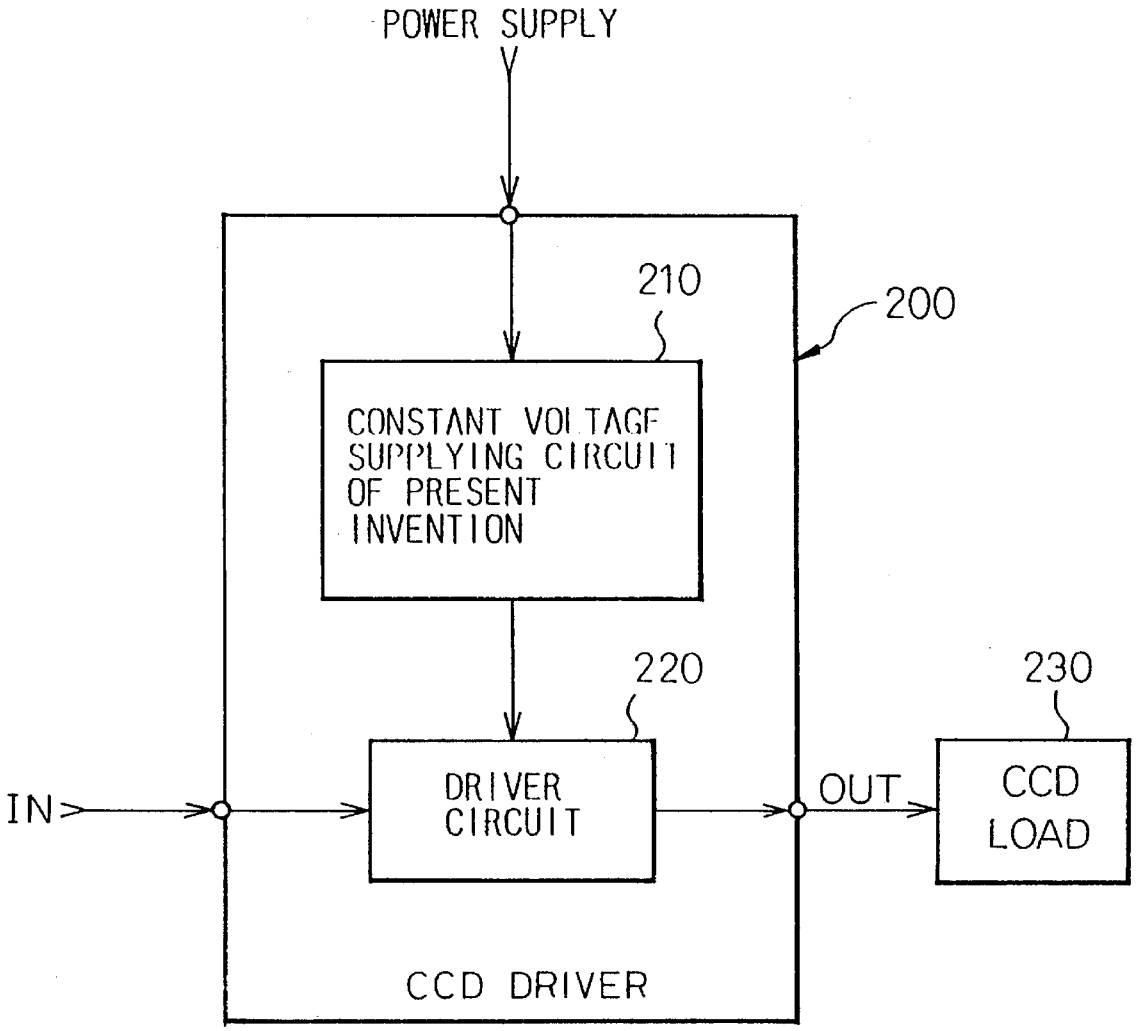
FIG. 34 is a block diagram showing an application of the constant voltage supplying circuit according to the present invention.

Additionally, FIG. 34 shows an application of the constant voltage supplying circuit according to the present invention.

In the illustration, reference 200 denotes a CCD driver which includes the constant voltage supplying circuit 210 according to the present invention, and a driver circuit 220 for driving a CCD load 230 upon receipt of the constant voltage supplied from the circuit 210. The CCD driver 200 is constituted in the form of one chip.

What is claimed is:

1. A constant voltage supplying circuit disposed between a load and a voltage output terminal of a voltage generation circuit for outputting a voltage having the same polarity as that of a reference voltage capable of being set arbitrarily, and having an absolute value greater than said reference voltage, comprising:

a first field effect transistor having a gate thereof connected to a drain thereof, and supplied with said reference voltage at a source thereof; and a second field effect transistor having the same conductivity type as that of said first field effect transistor, and having a gate thereof connected to the drain of said first field effect transistor, a source thereof connected to the voltage output terminal of said voltage generation circuit and a drain thereof grounded;

wherein a voltage at the voltage output terminal of said voltage generation circuit is stabilized to the same voltage value as said reference voltage.

2. The constant voltage supplying circuit according to claim 1, wherein each of said first and second field effect transistors comprises a MOS transistor.

3. The constant voltage supplying circuit according to claim 1, further comprising a reference voltage generation circuit for generating said reference voltage.

4. The constant voltage supplying circuit according to claim 1, further comprising a resistor connected between the drain of said first field effect transistor and the ground.

5. A constant voltage supplying circuit disposed between a load and a voltage output terminal of a voltage generation circuit for outputting a voltage having the same polarity as that of a reference voltage capable of being set arbitrarily, and having an absolute value greater than said reference voltage, comprising:

a first field effect transistor having a gate thereof connected to a drain thereof, and supplied with said reference voltage at a source thereof;

a second field effect transistor having the same conductivity type as that of said first field effect transistor, and having a gate thereof connected to the drain of said first field effect transistor, and a source thereof connected to the voltage output terminal of said voltage generation circuit;

a voltage difference generation circuit for generating a predetermined voltage difference between a drain of said second field effect transistor and the ground; and a third field effect transistor having a conductivity type different from that of said first field effect transistor, and having a gate thereof connected to the drain of said second field effect transistor, a drain thereof connected to the voltage output terminal of said voltage generation circuit and a source thereof connected to the ground;

wherein a voltage at the voltage output terminal of said voltage generation circuit is stabilized to the same voltage value as said reference voltage.

6. The constant voltage supplying circuit according to claim 5, wherein each of said first to third field effect transistors comprises a MOS transistor.

7. The constant voltage supplying circuit according to claim 5, wherein said voltage difference generation circuit comprises a resistor.

8. The constant voltage supplying circuit according to claim 5, wherein said voltage difference generation circuit comprises a series circuit of a resistor and a unidirectional device having the same threshold voltage as that of said third field effect transistor.

9. The constant voltage supplying circuit according to claim 5, further comprising a reference voltage generation circuit for generating said reference voltage.

10. The constant voltage supplying circuit according to claim 5, further comprising a resistor connected between the drain of said first field effect transistor and the ground.

11. A constant voltage supplying circuit disposed between a load and a voltage output terminal of a voltage generation circuit for outputting a voltage having the same polarity as that of a reference voltage capable of being set arbitrarily, and having an absolute value greater than said reference voltage, comprising:

a first voltage difference generation circuit for receiving said reference voltage and shifting the voltage level by a predetermined level;

a first field effect transistor having a gate thereof connected to an output terminal of said first voltage difference generation circuit and a source thereof connected to an output terminal of said constant voltage supplying circuit;

a second voltage difference generation circuit for generating a predetermined voltage difference between a drain of said first field effect transistor and the ground;

a second field effect transistor having a conductivity type different from that of said first field effect transistor, and having a gate thereof connected to the drain of said first field effect transistor and a source thereof connected to the ground;

a third voltage difference generation circuit for generating a predetermined voltage difference between a drain of said second field effect transistor and the voltage output terminal of said voltage generation circuit; and a third field effect transistor having a conductivity type different from that of said first field effect transistor, connected between the voltage output terminal of said voltage generation circuit and the output terminal of said constant voltage supplying circuit, and responsive to a drain potential of said second field effect transistor;

wherein an output voltage obtained at the output terminal of said constant voltage supplying circuit is stabilized to the same voltage value as said reference voltage.

12. The constant voltage supplying circuit according to claim 11, wherein each of said first to third field effect transistors comprises a MOS transistor.

13. The constant voltage supplying circuit according to claim 12, wherein said first voltage difference generation circuit comprises a MOS transistor having a gate thereof connected to a drain thereof and supplied with said reference voltage at a source thereof.

14. The constant voltage supplying circuit according to claim 13, wherein each of said second and third voltage difference generation circuits comprises a resistor.

15. The constant voltage supplying circuit according to claim 13, further comprising a plurality of resistors connected in series between the output terminal of said constant voltage supplying circuit and the ground, wherein the source of a MOS transistor as said field effect transistor is connected to one of the junctions of said resistors.

16. The constant voltage supplying circuit according to claim 13, further comprising a resistor connected between the gate of a MOS transistor as said first field effect transistor and the ground.

17. A constant voltage supplying circuit disposed between a load and a voltage output terminal of a voltage generation circuit for outputting a voltage having the same polarity as that of a reference voltage capable of being set arbitrarily, and having an absolute value greater than said reference voltage, comprising:

a first voltage difference generation circuit for receiving said reference voltage and shifting the voltage level by a predetermined level;

a first field effect transistor having a gate thereof connected to an output terminal of said first voltage difference generation circuit and a source thereof connected to an output terminal of said constant voltage supplying circuit;

a second voltage difference generation circuit for generating a predetermined voltage difference between a drain of said first field effect transistor and the ground;

a CMOS inverter driver circuit provided with a CMOS inverter connected between the voltage output terminal of said voltage generation circuit and the ground, and responsive to a drain potential of said first field effect transistor; and a second field effect transistor connected between the voltage output terminal of said voltage generation circuit and the output terminal of said constant voltage supplying circuit, and responsive to an output of said CMOS inverter driver circuit;

wherein an output voltage obtained at the output terminal of said constant voltage supplying circuit is stabilized to the same voltage value as said reference voltage.

18. The constant voltage supplying circuit according to claim 17, wherein each of said first and second field effect transistors comprises a MOS transistor.

19. The constant voltage supplying circuit according to claim 18, wherein said first voltage difference generation circuit comprises a MOS transistor having a gate thereof connected to a drain thereof and supplied with said reference voltage at a source thereof.

20. The constant voltage supplying circuit according to claim 19, wherein said second voltage difference generation circuit comprises a resistor.

21. The constant voltage supplying circuit according to claim 19, wherein, when said second field effect transistor comprises an n-MOS transistor, said CMOS inverter driver circuit includes a CMOS inverter of a one-stage structure, and an ON/OFF control of said n-MOS transistor is made by an output voltage of said CMOS inverter.

22. The constant voltage supplying circuit according to claim 19, wherein when said second field effect transistor comprises a p-MOS transistor, said CMOS inverter driver circuit includes CMOS inverters of a two-stage structure, and an ON/OFF control of said p-MOS transistor is made by an output voltage of a CMOS inverter of the final stage.

23. The constant voltage supplying circuit according to claim 19, wherein, when said second field effect transistor comprises a p-MOS transistor, said CMOS inverter driver circuit includes CMOS inverters of a two-stage structure, the source of a p-MOS transistor constituting a CMOS inverter of the initial stage is connected to a power supply line having a potential different from the output voltage of said voltage generation circuit, and an ON/OFF control of said p-MOS transistor is made by an output voltage of a CMOS inverter of the final stage.

24. The constant voltage supplying circuit according to claim 19, wherein, when said second field effect transistor comprises a p-MOS transistor, said CMOS inventer driver circuit includes a CMOS inverter of a one-stage structure, and an ON/OFF control of said p-MOS transistor is made by an output voltage of said CMOS inverter.

25. The constant voltage supplying circuit according to claim 19, wherein, when said second field effect transistor comprises an n-MOS transistor, said CMOS inverter driver circuit includes CMOS inverters of a two-stage structure, and an ON/OFF control of said n-MOS transistor is made by an output voltage of a CMOS inverter of the final stage.

26. The constant voltage supplying circuit according to claim 19, wherein, when said second field effect transistor comprises an n-MOS transistor, said CMOS inverter driver circuit includes CMOS inverters of a two-stage structure, the source of an n-MOS transistor constituting a CMOS inverter of the initial stage is connected to a power supply line having a potential different from the output voltage of said voltage generation circuit, and an ON/OFF control of said n-MOS transistor is made by an output voltage of a CMOS inverter of the final stage.

27. The constant voltage supplying circuit according to claim 19, further comprising a plurality of resistors connected in series between the output terminal of said constant voltage supplying circuit and the ground, wherein the source of a MOS transistor as said first field effect transistor is connected to one of the junctions of said resistors.

28. The constant voltage supplying circuit according to claim 19, further comprising a resistor connected between the gate of a MOS transistor as said first field effect transistor and the ground.

* * * * *